US007665338B2

(12) United States Patent
Cheppe et al.

(10) Patent No.: US 7,665,338 B2
(45) **Date of Patent: *Feb. 23, 2010**

(54) SHOT PEENING METHODS AND UNITS

(75) Inventors: Patrick Cheppe, Basse Goulaine (FR); Vincent Desfontaine, Blainville (CA); Jean-Michel Duchazeaubeneix, Les Sorinieres (FR); Philippe Jacob, Orvault (FR)

(73) Assignee: Sonats-Societe des Nouvelles Applications des Techniques de Surfaces, Carquefou (FR)

( * ) Notice: Subject to any disclaimer, the term of this patent is extended or adjusted under 35 U.S.C. 154(b) by 0 days.

This patent is subject to a terminal disclaimer.

(21) Appl. No.: 12/149,880

(22) Filed: May 9, 2008

(65) Prior Publication Data

US 2008/0282756 A1 Nov. 20, 2008

Related U.S. Application Data

(63) Continuation-in-part of application No. 11/637,747, filed on Dec. 13, 2006, now Pat. No. 7,389,663.

(30) Foreign Application Priority Data

Oct. 20, 2006 (FR) ..... 06 54428
Apr. 22, 2008 (FR) ..... 08 52703

(51) Int. Cl.
*C21D 7/00* (2006.01)
*B24C 1/00* (2006.01)

(52) U.S. Cl. ..... 72/53; 29/90.7; 451/38; 451/39

(58) Field of Classification Search ..... 72/53; 451/38, 39, 40; 29/90.7
See application file for complete search history.

(56) References Cited

U.S. PATENT DOCUMENTS

| | | | | |
|---|---|---|---|---|
| 6,289,705 | B1 | 9/2001 | Duquenne et al. | |
| 6,336,844 | B1 | 1/2002 | Duquenne et al. | |
| 6,343,495 | B1 | 2/2002 | Cheppe et al. | |
| 6,490,899 | B2 | 12/2002 | Berthelet et al. | |
| 6,505,489 | B2 | 1/2003 | Berthelet et al. | |
| 6,508,093 | B2 | 1/2003 | Berthelet et al. | |
| 6,606,892 | B2 | 8/2003 | Fischer et al. | |
| 6,837,085 | B2 | 1/2005 | Berthelet et al. | |
| 7,389,663 | B2 * | 6/2008 | Cheppe et al. | 72/53 |
| 7,481,088 | B2 * | 1/2009 | Bayer et al. | 72/53 |

(Continued)

FOREIGN PATENT DOCUMENTS

| | | |
|---|---|---|
| FR | 2 815 280 | 4/2002 |

(Continued)

*Primary Examiner*—David B Jones
(74) *Attorney, Agent, or Firm*—Oliff & Berridge, PLC

(57) ABSTRACT

The present invention provides a method of shot peening at least a portion of a rotary machine comprising a rotor. Shot peening is carried out with a rotor which is at least partly assembled. The method comprises:

fixing a system for supporting at least one acoustic assembly to the machine; and shot peening at least one region of the machine using projectiles which are moved by the acoustic assembly.

20 Claims, 20 Drawing Sheets

U.S. PATENT DOCUMENTS

2002/0042978 A1 4/2002 Cheppe et al.
2003/0115922 A1* 6/2003 Berthelet et al. ..... 72/53
2003/0130101 A1 7/2003 Hwang
2006/0021410 A1 2/2006 Cheppe et al.
2008/0092616 A1 4/2008 Cheppe et al.
2009/0011686 A1 1/2009 Bayer et al.
2009/0094829 A1 4/2009 Bunting et al.

FOREIGN PATENT DOCUMENTS

WO WO 2006/124616 * 11/2006
WO WO 2006/124616 A2 11/2006

* cited by examiner

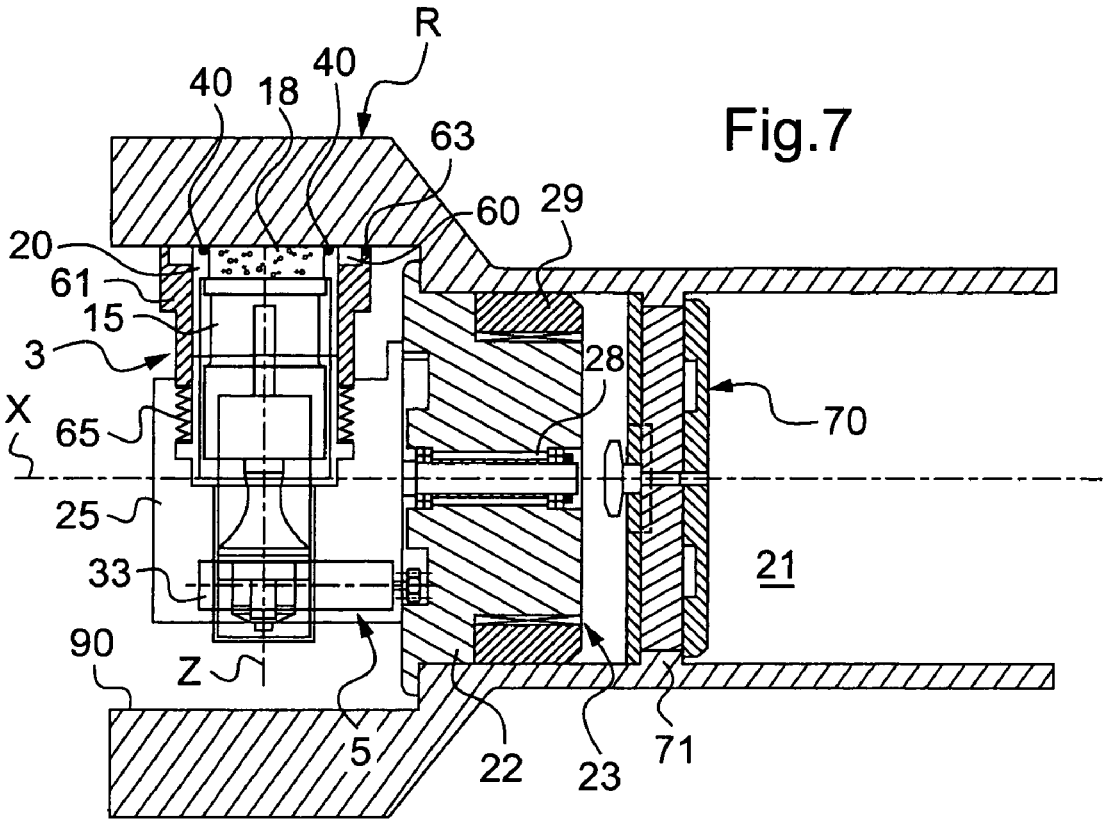
Fig.7
Fig.8
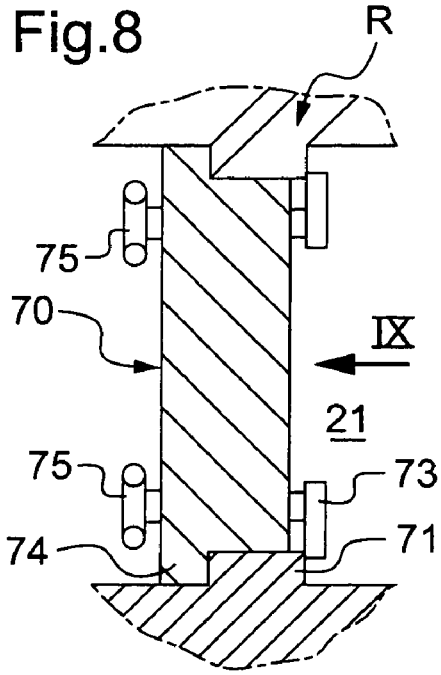
Fig.9
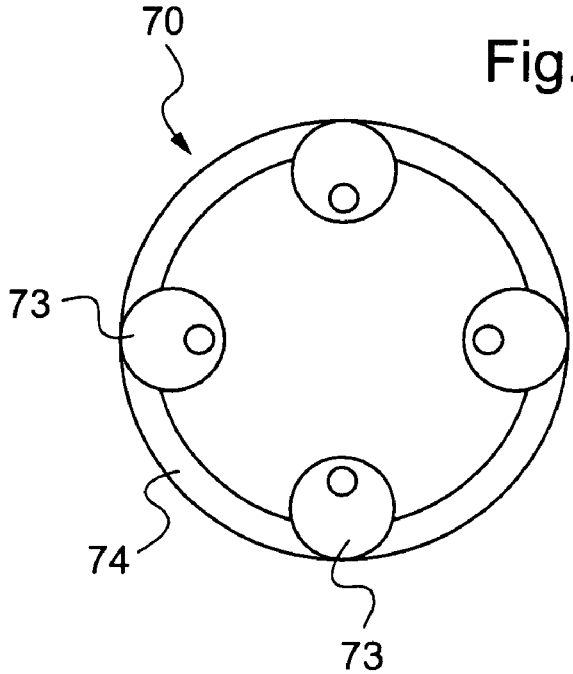

Fig.10
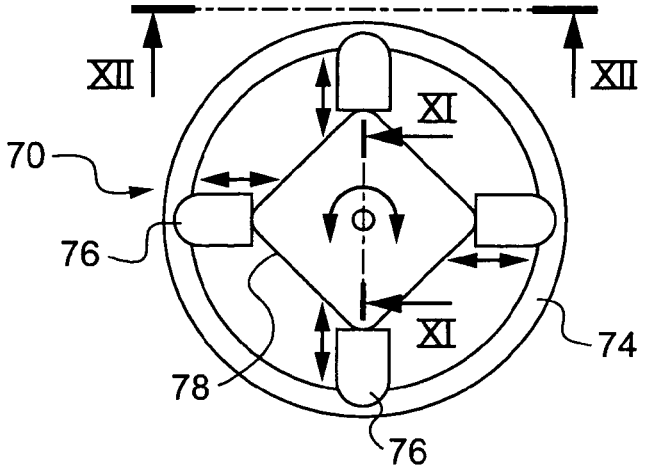
Fig.11
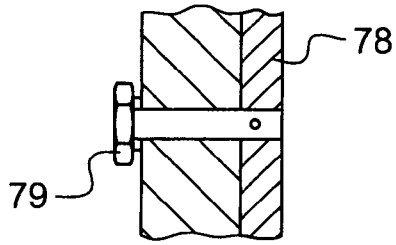
Fig.12
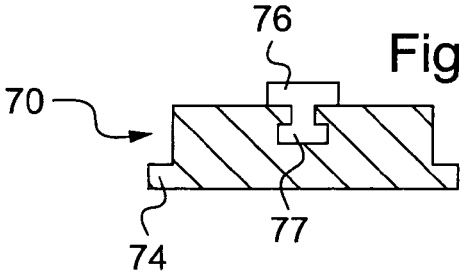
Fig.13
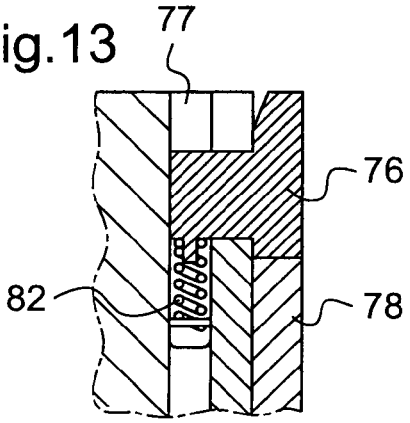
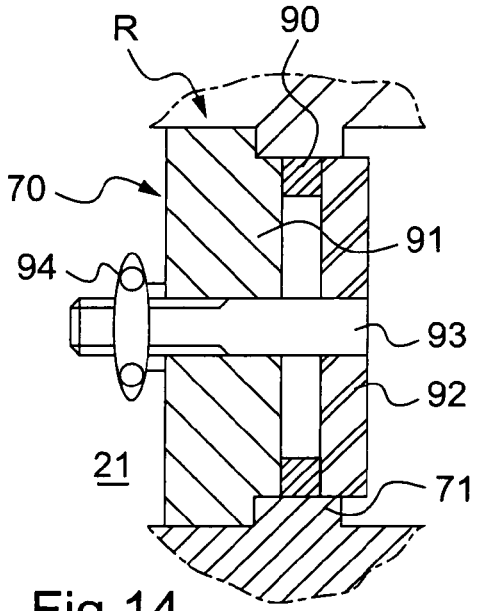
Fig.14
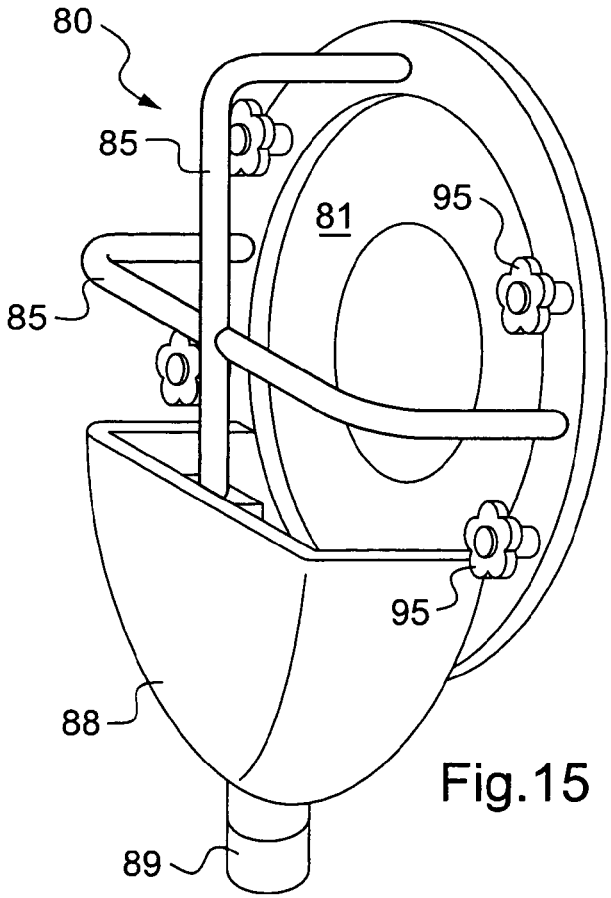
Fig.15

Fig.31
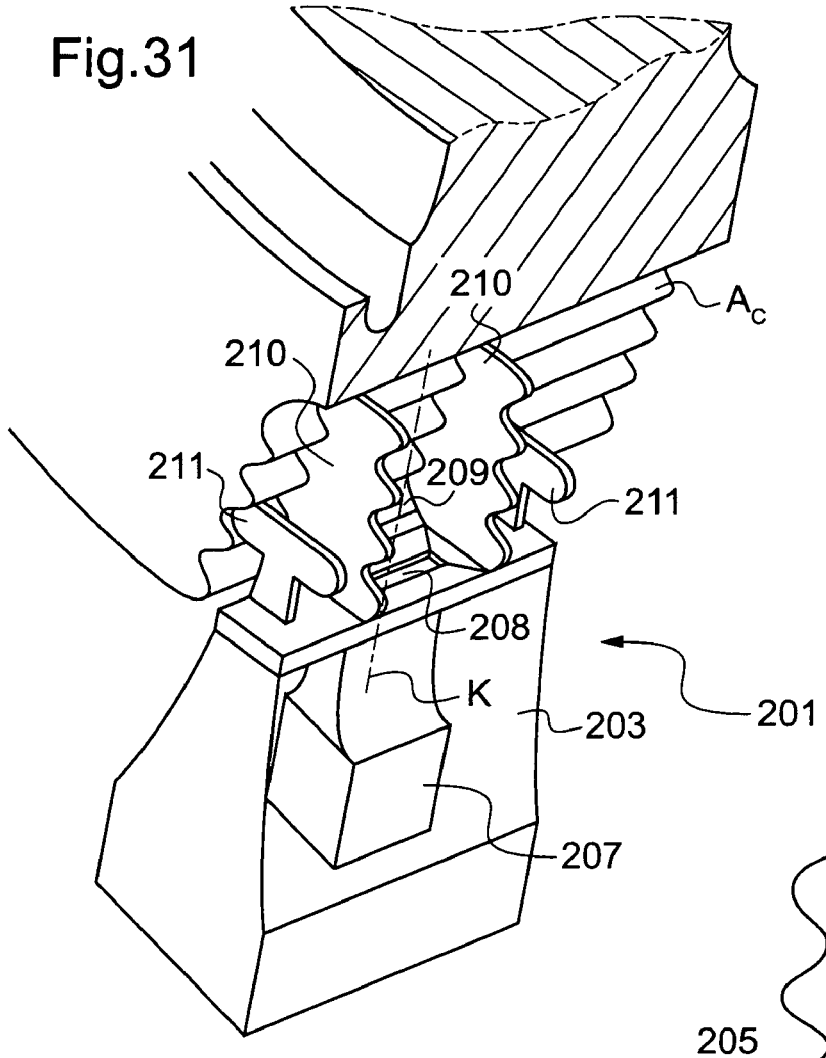
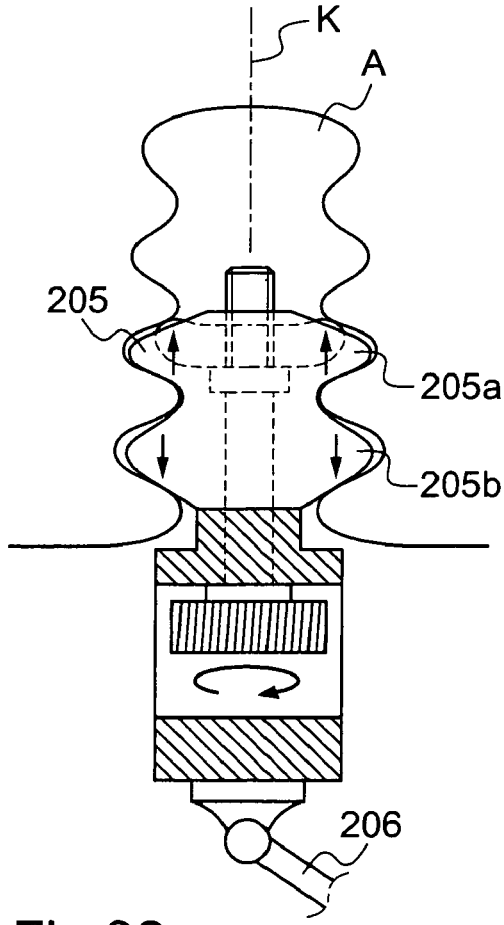
Fig.32

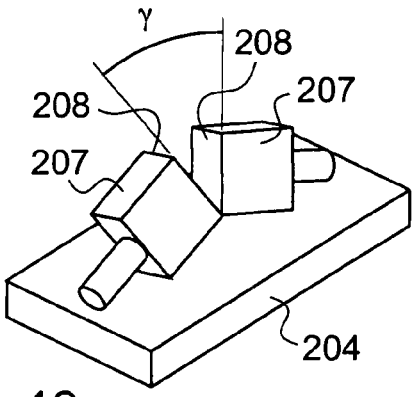
Fig.40
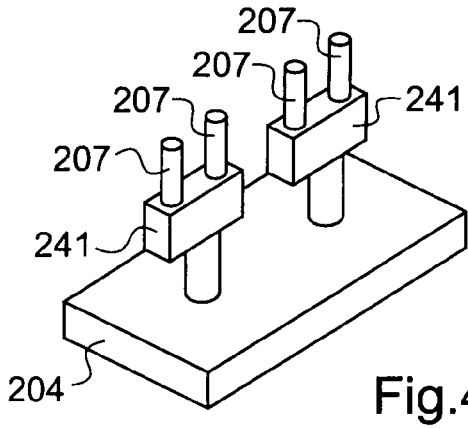
Fig.42
Fig.39
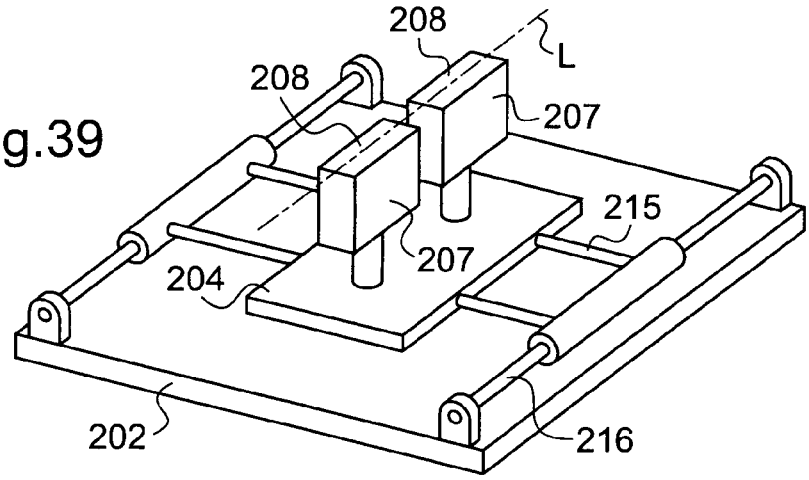
Fig.41
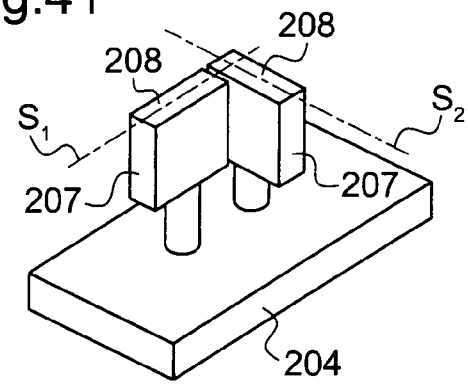
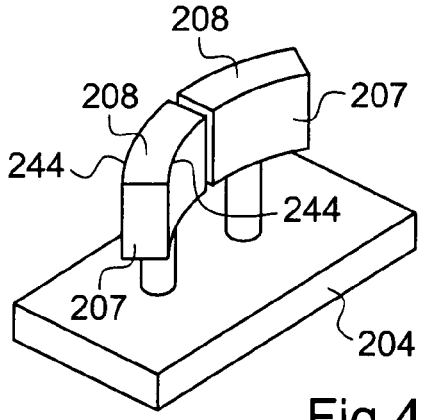
Fig.43

Fig.50
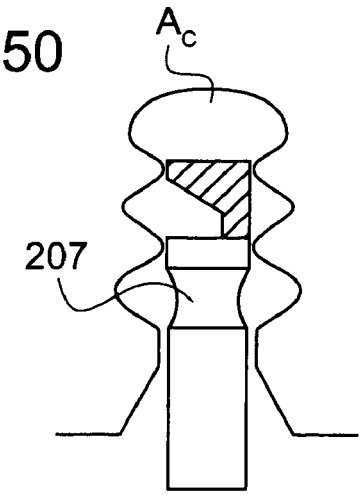
Fig.51
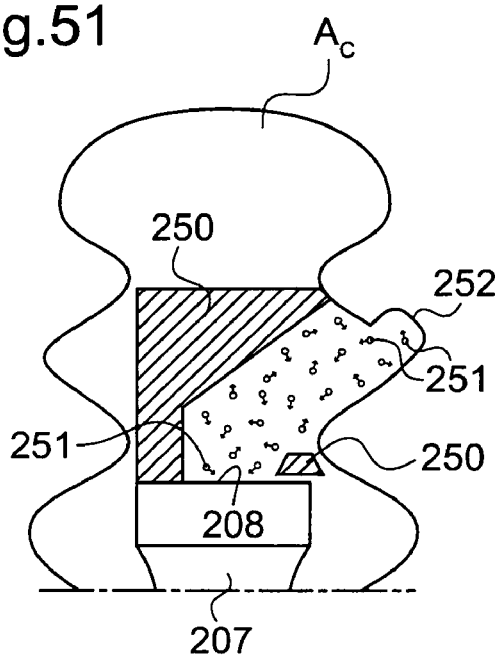
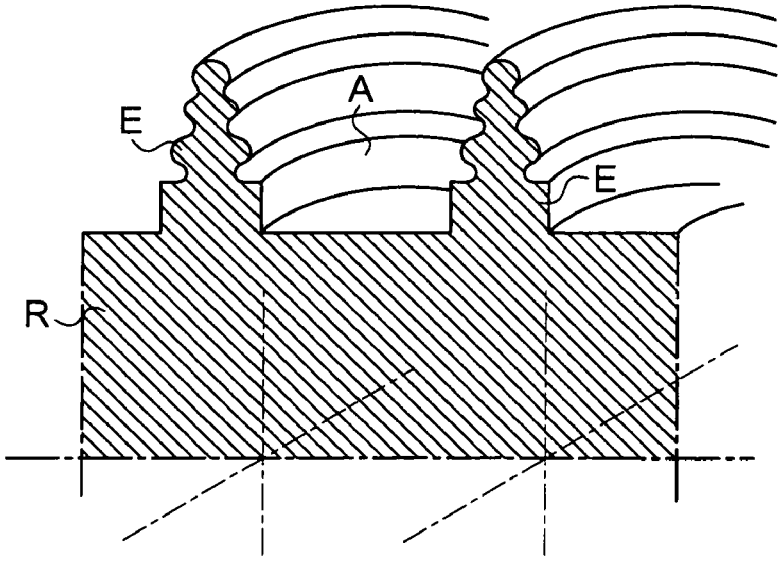
Fig.52

SHOT PEENING METHODS AND UNITS

This application is a continuation-in-part of U.S. Ser. No. 11/637,747 filed on Dec. 13, 2006 and claiming the benefit of French Application No. 06 54428 filed on Oct. 20, 2006, the disclosure of which is incorporated herein in its entirety. This application also claims the benefit of French application FR No. 08 052703 filed on Apr. 22, 2008, the disclosure of which is incorporated herein in its entirety.

FIELD OF INVENTION

The present invention relates to shot peening methods and units comprising an acoustic assembly and projectiles set into motion by the acoustic assembly.

BACKGROUND

U.S. Pat. No. 6,343,495 discloses a portable device for local shot peening of a part to introduce compressive stress or to modify its surface quality.

United States application US 2002-0042978, French patent FR-A-2 815 280 and US 2006-0021410 disclose units in which the part to be treated is at least partly introduced into the unit.

Such units are suitable when treating component parts of a machine during fabrication thereof or when maintaining it after dismantling the machine completely.

SUMMARY

Whenever stopping the machine is expensive, a need exists for shortening, as far as possible, the duration of a maintenance operation involving shot peening.

The invention seeks to satisfy this need, inter alia.

Thus, in one aspect, the invention provides a method of shot peening at least a portion of a rotary machine comprising a rotor, in which shot peening is carried out with the rotor being at least partly assembled, the method comprising:

fixing a system for supporting at least one acoustic assembly to the machine; and shot peening at least one region of the machine using projectiles which are brought into motion by the acoustic assembly.

The treatment may be carried out on site, for example in a power station or close to an aircraft provided with the machine, or in a factory, but in both circumstances on a rotor that is at least partly assembled.

Down time may thus be reduced since the machine does not have to be completely dismantled.

The term "rotor that is at least partly assembled" means that the rotor is not removed completely from the stator of the machine, or that the rotor is not mounted in the stator but is not completely dismantled, the treated rotor part being assembled with other rotor components such as one or more disks or housings and/or shafts and/or cables, for example. The rotor may comprise, during the shot peening treatment, at least the majority of the components it possesses when the rotor is in position ready to operate in the rotary machine.

The treatment may, for example, be aimed at introducing compressive stresses to prevent cracks from propagating in the part in its existing shape, or after fresh machining thereof to repair it or modify its shape.

The rotor may optionally include, at its periphery, recesses for fixing blades (also termed fins or vanes) by mechanical cooperation between each recess and the root of the corresponding blade.

In the presence of blades, the support system may be fixed on the rotor in a manner that differs from using the current recess to be treated, for example in a recess adjacent to the current recess.

In one exemplary embodiment, the support system comprises a hinge that allows the acoustic assembly to rotate about at least one axis of rotation which may coincide with that of the rotor. The acoustic assembly may, for example, be displaced in rotation through at least 360° about the axis of rotation of the rotor as a function, for example, of the shape and the position of the region to be treated.

The method of the invention may be suitable, for example, for treating a gas or steam turbine rotor, for example an aircraft turbine or a ground-based turbine.

The treated region comprises, for example, an edge defined by the junction between a surface of the rotor that is transverse, for example perpendicular, to the axis of rotation and a surface of revolution about the axis of rotation, for example a cylindrical or conical surface. To treat such a region, the acoustic assembly may be positioned facing the edge and driven in rotation along it.

The acoustic assembly comprises a vibrating surface from which projectiles ricochet, which surface may, for example, be planar, concave, convex, conical, pyramidal, in the shape of a bowl, or otherwise. A normal to the vibrating surface may, for example, be orientated at about 45° relative to the axis of rotation of the rotor. Other orientations are possible as a function of the shape of the vibrating surface and that of the treated region.

If necessary, the orientation of the vibrating surface relative to the axis of rotation of the rotor may vary with time in order, for example, to be able to treat a complex shape more easily.

The treated region may also be located on a central bore of the rotor or elsewhere, for example in a peripheral recess, on a leading edge of the rotor or stator, on a vane, for example a vane of a one-piece rotor and more generally on any surface that requires local or complete shot peening treatment, for example a surface that may optionally extend over one complete turn. The method of the invention may, where appropriate, be limited to local retouching.

The acoustic assembly may optionally function constantly during treatment of the region concerned.

Depending on circumstances, for example when treating peripheral recesses, at least one first treatment of a first region of the machine, for example a first recess, may be carried out followed by a second treatment which may be carried out on a second region of the machine, for example a second recess, which is spaced circumferentially from the first region, and with a relative displacement being performed between the machine and the acoustic assembly between the two treatments, the acoustic assembly not operating between the two treatments.

Several acoustic assemblies may function simultaneously, where appropriate. An acoustic assembly may comprise one or more sonotrodes.

An acoustic assembly may, for example, comprise a plurality of sonotrodes disposed side by side to treat an extended region, for example to treat the entire length of a recess. Where appropriate, the axes of the various acoustic stacks associated with the sonotrodes are not co-planar in order, for example, to be able to treat a recess extending along a longitudinal axis that is curvilinear. The axes of the various acoustic stacks may be mutually parallel.

The sonotrodes may belong to respective acoustic stacks that are, for example, carried by a common part. An acoustic stack may be fixed to said part at a vibration node. The sonotrodes may have vibrating surfaces against which the projectiles will impinge, which surfaces are elongate in shape, for example rectangular.

The major axes of two adjacent vibrating surfaces which are, for example, substantially rectangular in shape, may form an angle. A wedge-shaped seal may be disposed between two adjacent sonotrodes to prevent projectiles from becoming stuck between the sonotrodes.

The use of a plurality of sonotrodes with substantially rectangular-shaped vibrating surfaces may have the advantage of performing treatment with relatively high intensity.

The support system may in general be fixed either on the stator or on the rotor. However, fixing on the rotor may be preferable in some situations, for example when it is the rotor that is to be treated.

The support system is, for example, fixed in a central bore of the rotor, if such a bore exists.

Fixing in a central bore may simplify rotating the acoustic assembly about the axis of rotation of the rotor. Where appropriate, this may also allow the use of a support to plug the bore and prevent projectiles from accidentally penetrating inside the machine.

Fixing may also be carried out on a peripheral recess if at least part of one or more peripheral recesses are to be treated.

In one example, proper positioning of the support system on the rotor, for example in the central bore, in a recess or elsewhere, is detected automatically and operation of the acoustic assembly or assemblies is inhibited if positioning is poor.

Automatic detection may further reduce the time taken for the operation, by reducing the number of verification steps which the operator must carry out before introducing projectiles and/or before switching on the acoustic assembly or assemblies.

Any detection means may be used for this purpose based, for example, on using one or more resistive, capacitative, inductive, optical, or other sensors or contactors.

The support system may include a motor to displace the acoustic assembly relative to the rotor, for example in rotation. In a variation, the acoustic assembly may be displaced manually. Displacement of the acoustic assembly, for example driving it in rotation, may be carried out continuously or incrementally.

The motor may be stationary relative to the machine. In a variation, the motor may be movable relative to the machine, for example mounted in a part of the support system that displaces with the acoustic assembly, for example rotating therewith.

The support system may come into contact with the machine over a relatively extended surface. In a variation, contact may be a point contact, for example at at least three points if centering is envisaged.

The support system may include a first portion which is stationary relative to the machine and a second portion which is movable relative to said first portion with at least one hinge interposed between the stationary and movable portions, the acoustic assembly being carried by the second portion. Where appropriate, the support system is arranged to allow adjustment of the centering of the second portion relative to the first portion. The above-mentioned hinge may include one or more bearings.

The support system may include means for detecting movement of the second portion relative to the first portion, for example an encoder.

The support system may be fixed on the rotor in order to treat a region of the stator. Where appropriate, displacement of the acoustic assembly may result from displacement of the rotor relative to the stator.

When the rotor comprises a central bore, which may be the case, for example, with a rotor of an airplane engine, it may be advantageous to dispose a safety barrier in said central bore to reduce the risk of projectiles escaping through the central bore into the machine, making it necessary to dismantle the machine to recover them.

The safety barrier may be provided with detection means that are sensitive to the position of the barrier on the rotor. Operation of the acoustic assembly may be prevented if poor positioning, which runs the risk of projectile loss, is detected. The detection means may comprise one or more resistive, capacitative, inductive, optical, or other sensors or contactors.

The safety barrier may be fixed on the rotor in a variety of manners, for example by radial expansion or using at least one locking element which may, for example, bear on a shoulder of the bore, for example behind a rib forming a projection in the bore.

The safety barrier may also be maintained by other means, such as adhesive tape, an adhesive, or one or more magnets.

The invention may also, inter alia, be applicable to treating a rotor including a plurality of peripheral recesses for fixing blades, for example in a gas or steam turbine, for producing mechanical and/or electrical energy.

The recesses may be treated in succession, each individually, or in groups of recesses.

In accordance with one aspect of the invention, the support system may be arranged to be fixed other than in the current recess to be treated.

The term "current" recess denotes the recess in which the projectiles are located when the acoustic assembly operates and the support system is in position on the machine. Fixing the support system other than in the current recess allows the current recess to be treated in its entirety if desired.

For certain rotors, holes open into the recesses and act, for example, to channel a stream of cooling air or lubricant. It may be desirable to plug any holes of each current recess to be treated in order to prevent projectiles from escaping via the holes during treatment. In certain circumstances, said plugging may advantageously be carried out using a plugging system that is independent of the support system. The fact that the plugging system is independent of the support system may have the advantage of facilitating adaptation of the plugging system to the hole, despite dimensional variations that may be encountered in certain rotors.

The plugging system may in particular comprise at least one plugging member positioned so as to be introduced into a recess other than the current recess.

In one exemplary implementation of the invention, the treatment method may comprise:

automatically detecting complete plugging of a hole; and inhibiting operation of the acoustic assembly if incomplete plugging of the hole is detected.

This may avoid the need for the operator to make time-consuming verifications and increase machine down-time.

Detection may be carried out because a plugging member may include at least one contactor arranged to change state when the plugging member is in a hole-plugging configuration.

In one implementation of the invention, a treatment chamber may be defined by the acoustic assembly and the region to be treated, the method comprising:

automatically detecting sufficient closure of the treatment chamber to prevent projectiles from departing; and inhibiting operation of the acoustic assembly in the event of insufficient closure of the treatment chamber.

In one exemplary implementation of the invention, the method may comprise:

introducing projectiles into a treatment chamber at least partially defined by the acoustic assembly and the region to be treated, the projectiles initially being at a distance from a vibrating surface of the acoustic assembly; and initiating movement of projectiles by injecting at least one jet of compressed air into the treatment chamber to project them at least partially against the vibrating surface.

The projectiles may be introduced manually or automatically into the treatment chamber, the operator displacing, for example, a movable closure means in the treatment chamber between a first position for confining projectiles away from the region to be treated and a second position allowing projectiles to reach the region to be treated.

In one implementation, the movable closure means is prevented from being displaced into the second position when the detection means present in the unit indicates a risk of projectile loss.

By way of example, a closure locking member may be provided for this purpose, for example when the closure is manually displaceable. When the closure is displaced automatically, control of its displacement may be deactivated when the above-mentioned risk exists.

Means for detecting a risk of projectile loss may be positioned on the elements for forming the primary chamber which co-operates with the vibrating surface and the treated region to define the treatment chamber where the projectiles are imprisoned throughout treatment.

Other detection means may also be located on elements for forming a secondary chamber located outside the primary chamber.

The invention also provides a shot peening unit for treating a rotary machine including an at least partly assembled rotor, the unit comprising:

a support system; and an acoustic assembly carried by the support system;

the support system allowing the acoustic assembly to be fixed to the machine without completely dismantling the rotor, for example without extracting the rotor from the machine.

The term "fixing the acoustic assembly to the machine" means that the support system can if necessary be fixed to the rotor alone when it has been removed from the stator but has not been completely dismantled.

In the presence of recesses at the periphery of the rotor, the fixing system may be arranged to be fixed other than in the current recess to be treated, for example in an adjacent recess.

The support system may include a portion arranged to be fixed to the rotor, for example in a central bore thereof. Fixing may, for example, be assured by expansion of a portion of the support system.

The support system may comprise at least one hinge allowing rotation of the acoustic assembly about an axis of rotation coinciding with the axis of rotation of the rotor.

The support system may include a centering system which can cause an axis of rotation of the acoustic assembly coincide with the axis of rotation of the rotor.

The support system may be arranged to allow displacement of the acoustic assembly along the longitudinal axis thereof and/or to allow the orientation of the longitudinal axis of the acoustic assembly to be adjusted, in particular its orientation relative to the axis of rotation.

These adjustment means allow the acoustic assembly to be displaced relative to the support system as a function of the shape of the machine and that of the region which is to be shot peened.

As mentioned above, the support system may comprise elements for forming a primary chamber, defining the treatment chamber with the vibrating surface and the treated region.

These elements for forming the primary chamber may be provided with at least one detector for detecting sufficient sealing of the treatment chamber, for example for detecting whether the clearance between at least one element for forming the primary chamber and the part to be treated is smaller than the dimensions of a projectile, in particular less than or equal to half the diameter of a projectile.

The support system may also include elements for forming a secondary chamber, outside the primary chamber, intended to provide additional protection against the risk of accidental departure of a projectile from the treatment chamber formed by the primary chamber.

These elements for forming the secondary chamber may include at least one detector for detecting sealing of the secondary chamber sufficient to prevent the projectiles from departing, for example for detecting that the elements for forming the secondary chamber are bearing against the machine to be treated and/or the support system.

The detectors used both for the elements for forming the primary chamber and those for forming the secondary element may comprise at least one contactor, for example of the micro-switch type, or an inductive, capacitative, resistive, or even optical sensor.

The elements for forming a primary or secondary chamber may be biased towards a position for closing the secondary chamber by at least one resilient return member such as a spring, for example.

The unit may include a system for providing protection against external shocks, defining a space containing the acoustic assembly. This shock protection system may be sealed to projectiles, being intended at least to limit the risk of accidental collision of an operator or an object against the acoustic assembly, which collision could modify the position of the acoustic assembly and/or the support system relative to the machine and cause an accidental loss of projectiles.

The shock protection system may include a lower non-perforate portion to recover a projectile that has dropped into it. The bottom portion of said non perforate portion may be terminated by a projectile recovery stopper.

The shock protection system may include, in its top portion, one or more bars, or a screen, or a transparent wall in order to provide visual access to the acoustic assembly.

The shock protection system may be provided with detection means to detect proper positioning of the protection system relative to the machine to be treated.

These detection means may, for example, comprise a detector that is sensitive to the protection system bearing against the machine, for example a contactor that changes state by bearing on the rotor when the system is correctly positioned.

As mentioned above, the unit may include a safety barrier to be disposed in a bore of the rotor to close it.

The support system may include at least one detector that inhibits operation of the acoustic assembly in the event of poor positioning of the support system.

When the support system is intended to be fixed in the bore of the rotor, said detector may, for example, comprise a contactor which changes state on coming to bear against the rotor when the support system is correctly positioned.

The unit may also, for example, be arranged to treat the central bore of the rotor or the recesses located at the periphery of the rotor.

The support system may comprise an arm, which may optionally be hinged, the end of which is arranged to be fixed by mechanical cooperation in a recess adjacent to the current recess. This arm may, for example, include an end having a shape which is complementary to the recess and is engaged therein by a sliding movement.

The support system may comprise one or more slides which allow the acoustic assembly to be displaced relative to the current recess to move towards or away from the bottom of the recess and/or to displace it along the recess.

The unit may include one or more closure elements that are placed in the current recess and/or close thereto, to define a treatment chamber. At least some of the closure elements are, for example arranged to follow the shape of one or more flanks of the current recess.

When the support system is arranged to allow displacement of the acoustic assembly along the longitudinal axis of the current recess, the unit may include one or more closure elements arranged to slide in the recess and that are disposed either side of a vibrating surface of the acoustic assembly.

Said closure elements may be displaced along the recess during treatment thereof, being, for example, integral with the acoustic assembly and/or with part of the support system.

The unit may comprise a plurality of acoustic assemblies.

The unit may comprise a plurality of sonotrodes disposed side by side with, where appropriate, clearance between them that is smaller than the diameter of a projectile. These various sonotrodes disposed side by side may follow a curvilinear path in order to treat a recess with a longitudinal axis that is curvilinear.

The sonotrodes are, for example, supported by acoustic stacks connected by a holding piece. Each acoustic stack is fixed to the holding piece, for example at a vibration node for the acoustic assembly.

At least two sonotrodes may have vibrating surfaces from which the projectiles ricochet, which surfaces are substantially rectangular in shape, with the long side orientated along a major axis.

The major axes of two adjacent sonotrodes may make an angle between them. A seal may be disposed between two adjacent sonotrodes to prevent projectiles from becoming stuck between the sonotrodes and/or to reduce surface discontinuities between the sonotrodes.

In another aspect, the invention provides an acoustic assembly comprising a plurality of sonotrodes disposed side by side. The axes of the acoustic assemblies comprising these sonotrodes may be non coplanar while remaining parallel to each other. For example, said axes intersect the longitudinal axis of a recess to be treated, in which the sonotrodes are partially engaged.

The sonotrodes may have vibrating surfaces with substantially rectangular shapes. A seal may be disposed between two adjacent sonotrodes, said seal possibly being wedge-shaped.

The invention also provides a method of shot peening a rotary machine including a rotor, the rotor presenting recesses in its periphery, the method seeking to shot peen at least a portion of one of said recesses, the method comprising the steps consisting in:

fastening at least one connection arm of a support system in at least one recess other than a current recess for treatment, by engaging a connection part of said connection arm in the recess and locking the connection part using at least one of a counter-thrust system bearing against the rotor other than in the current recess and a clamping system acting on the connection part; and shot peening at least a portion of the current recess with an acoustic assembly secured to the support system.

The recesses may have walls presenting portions in relief having a variety of shapes that enable blades to be assembled. For example, in axial section, they may present a dovetail, Christmas-tree, or other shape.

The recesses may also be formed between male blade-connection portions, the male portions projecting from the rotor and presenting a Christmas-tree shape, for example.

The treated portion of the recess may optionally be a portion that comes into contact with the blade.

The treated portion may, for example, be a hole opening out into the portion of the recess that is used for fastening the blade, said hole serving to cool the blade, for example.

The connection arm may be fastened in a recess adjacent to the current recess for treatment.

The method may comprise fastening connection arms in at least two recesses situated respectively on either side of the current recess for treatment.

Each arm may have a connection part that is locked in the corresponding recess using a counter-thrust system bearing against the rotor other than in the recess, e.g. on a surface of the rotor that is adjacent to the opening of the recess or on a surface of the rotor that is situated in another recess.

Fastening can also be provided by a clamping system acting on the connection part, e.g. to expand it or to cause it to bear against at least two surfaces of the recess by exerting forces in opposite directions.

In an implementation of the invention, the acoustic assembly is moved relative to the support system in order to treat the current recess.

The connection arms may be movable relative to the support system. The connection arms may comprise connection parts that are arranged to lock in the corresponding recesses by changing shape.

The connection parts may for example bear against surfaces of the side walls of the recesses that extend substantially transversely to an axis passing through the bottom of the recess and through its opening.

The connection part may for example bear against two surfaces of facing portions in relief of the side walls of the recess, or against a surface in relief of the wall of the recess that faces towards the bottom of the recess, and against a surface situated in the vicinity of the recess, and outside it, e.g. at two locations. In a variant, the connection arms can be locked to the rotor by acting on the spacing between the arms, for example. The connection parts may be deformed mechanically, hydraulically, or pneumatically, amongst other possibilities.

At least a portion of the acoustic assembly, e.g. the sonotrodes secured to the support system, may be movable relative thereto, e.g. in rotation about the longitudinal axis of the acoustic assembly, and/or transversely relative to the longitudinal axis of the acoustic assembly.

The acoustic assembly may be secured to guides that bear against the current recess. Such guides, which may be two in number, for example, can enable the treatment chamber and the acoustic assembly to be oriented and positioned relative of the current recess for treatment. Under such circumstances, the acoustic assembly may be able to move transversely and/or to turn freely on the support, with the acoustic assembly being caused to move or turn relative to the support system solely by pressure from the guides.

The acoustic assembly may be moved relative to the recess under drive from at least one motor, e.g. on the basis of knowledge about the profile of the recess for treatment or with the help of sensors inserted therein.

The acoustic assembly may comprise at least one sonotrode. The sonotrode may have an end face that serves to set the projectiles into motion, said end face extending along a longitudinal axis that is rectilinear or curvilinear, e.g. that is curved about an axis parallel to the longitudinal axis of the sonotrode. Such a curved shape for the end face forming the vibrating surface may serve to match a recess for treatment that is itself curved. The acoustic assembly may include at least one carrier part supporting at least two sonotrodes. This can make it possible to treat simultaneously at least two localized zones of the current recess for treatment. The number of zones treated simultaneously is equal to the number of sonotrodes, which number can be greater than or equal to two.

In addition to the acoustic assembly, the support system may also support at least one sensor for improving guidance of the acoustic assembly inside the part for treatment, and in particular the sonotrode in the recess.

The support system may include at least one measurement tool serving to measure at least one characteristic of the part before and/or after treatment by shot peening. The support system may rest directly and/or indirectly on the ground via any type of leg assembly, or it may be carried completely by the rotor.

The support system may include at least two acoustic assemblies, each comprising a sonotrode, and by way of example the end faces of said at least two sonotrodes may be directed one towards the other, at least in part. This can make it possible to treat a projecting edge or two opposite faces of a wall, for example.

The support system may include at least two acoustic assemblies, each comprising a sonotrode, the end faces of said at least two sonotrodes being elongate along two respective longitudinal axes that form between them an angle, e.g. being mutually perpendicular. The end faces may be plane or otherwise, coplanar or otherwise. By way of example, this can make it possible to treat the current recess for treatment simultaneously with other zones that are situated at the periphery thereof.

The method of the invention may also include at least one of the following steps:

removing the fastener arm(s);

moving the support system and/or the rotor relative to each other; and fastening the support system on one or two other recesses situated respectively on either side of a new recess for treatment.

It is possible to repeat at least one of the above-described steps, e.g. so as to treat all of the recesses of the rotor.

The shot peening may be performed, for example, so as to obtain an Almen intensity of not less than F10N.

Independently or in combination with the above, the invention also provides a method of shot peening at least a portion of a rotary machine including a rotor, the rotor presenting recesses in its periphery, the method comprising the steps consisting in:

fastening connection arms of a support system in at least two recesses situated respectively on either side of a current recess for treatment; and shot peening the current recess by means of an acoustic assembly secured to the support system.

Independently or in combination with the above, the invention also provides a device for shot peening the rotor of a rotary machine, the device comprising:

a support system; and an acoustic assembly secured to the support system;

the support system comprising at least one arm having a connection part capable of being fastened in a recess other than the current recess for treatment, and locking means for locking the connection part;

the locking means comprising a counter-thrust system bearing against the rotor other than in the current recess for treatment and/or a clamping system acting on the connection part.

Independently or in combination with the above, the invention also provides a device for shot peening the rotor of a rotary machine, the device comprising:

a support system; and an acoustic assembly secured to the support system;

the support system comprising at least two connection arms enabling connection to be made to two recesses of the rotor situated respectively on either side of a current recess for treatment by the acoustic assembly.

Independently or in combination with the above, the invention also provides a method of shot peening at least a portion of a rotary machine including a rotor, the rotor presenting recesses in its periphery, the method comprising the steps consisting in:

introducing a vibrating surface of a sonotrode at least in part inside a recess for treatment; and shot peening at least part of the recess with the help of the sonotrode.

The sonotrode may be provided with an anvil that serves to deflect the projectiles, e.g. for the purpose of treating a surface of the recess that is difficult to access otherwise.

Independently or in combination with the above, the invention also provides a sonotrode, characterized in that its vibrating surface for contacting the projectiles is elongate along a curvilinear longitudinal axis, said surface optionally being plane.

Independently of the above, the invention also provides a method of shot peening a rotary machine having a partially assembled rotor, the rotor being provided in its periphery with recesses, the method comprising treating at least a portion of the rotor, e.g. at least one recess, using at least one acoustic assembly secured to a cradle that is movable in rotation concentrically about a longitudinal axis of the rotor.

The partially assembled rotor is at its site of utilization and it has not been dismantled completely. For example, the blades have been removed, but the rotor is in its utilization environment.

The acoustic assembly comprises at least one sonotrode having an end face that is excited in such a manner as to project projectiles against the wall of the rotor portion for treatment, e.g. one or more recesses for treatment in full or in part.

The cradle may be mounted on a frame. The frame may be positioned on a leg assembly in a manner that is adjustable in height and/or horizontally, e.g. parallel to the longitudinal axis of the rotor.

The frame may carry positioning chocks so as to make it easier to place the cradle concentrically relative to the rotor and to keep it in this position. The chocks may be arranged to bear continuously against a surface of the rotor constituting a surface of revolution. The chocks may optionally be removable.

The frame may include curved guide rails on which the cradle can move relative to the frame. By way of example, the guide rails may extend over an angular range greater than or equal to 30°, e.g. about 40°, or even about 60°. The rails may be secured in non-releasable manner on the frame, or in a variant, they may be fastened releasably so as to enable to them be replaced, where necessary, by rails presenting some other shape, e.g. having a different radius of curvature, adapted to a different rotor or to a different size.

The cradle may carry the acoustic assembly in a manner that enables the acoustic assembly to move relative to the cradle in rotation, in translation, or in complex manner. For example, for a fixed position of the cradle, it is possible to move the acoustic assembly relative thereto. In a variant, it is possible to move the cradle relative to the frame, while the acoustic assembly remains in a fixed position relative to the cradle. During shot peening treatment, it is possible to combine movement of the acoustic assembly relative to the cradle and movement of the cradle relative to the frame so as to enable the acoustic assembly to move in more complex manner relative to the frame and to the rotor. The shot peening treatment can also be performed while the acoustic assembly is stationary relative to the frame.

The cradle may comprise two uprights that are spaced apart by a fixed distance, or in a variant by a spacing that is adjustable.

Where appropriate, the or each upright may serve to close one or more recesses at their ends. Optionally, the or each upright may extend the or each recess so as to enable the recess to be treated in full, and possibly also to enable the inlet surfaces thereof to be treated, in particular outside the recess.

It is also optionally possible to treat a plurality of recesses simultaneously, if the cradle carries a plurality of acoustic assemblies, each having at least one sonotrode. The shot peening treatment may be performed while the rotor is stationary, by moving the cradle over a certain angular range. When the rotor has been treated in said angular range, in full or in part, the rotor may be turned through approximately the same angular range, or through a slightly smaller angular range, and then held stationary again, after which treatment is repeated by moving the cradle again along its rails. This operation can be repeated so as to cover the entire periphery of the rotor that is in need of treatment by shot peening.

BRIEF DESCRIPTION OF THE DRAWINGS

The invention can be better understood from the following detailed description of non-limiting implementations thereof, and from an examination of the accompanying drawings, in which:

FIGS. 3 to 7 are fragmentary and diagrammatic axial sections showing examples of the positioning of the support system and of the acoustic assembly relative to examples of rotors;

FIG. 8 is a diagram showing an example of a safety barrier in isolation and in axial section;

FIG. 9 is a diagrammatic rear view along IX of FIG. 8;

FIG. 10 is a diagrammatic rear view of another example of a safety barrier;

FIGS. 11 and 12 are fragmentary and diagrammatic sections respectively on XI-XI and XII-XII of FIG. 10;

FIG. 13 shows a detail of the barrier of FIG. 10;

FIG. 14 is a fragmentary and diagrammatic axial section of another example of a safety barrier;

FIG. 15 is a diagrammatic perspective view of a system for providing protection against external shocks, which system may be included in a unit of the invention;

FIG. 31 is a diagrammatic and fragmentary view, partially in section, showing how the treatment chamber is formed;

FIG. 32 is a diagrammatic and fragmentary section view showing how a connection arm is fastened in a recess;

FIG. 39 is a diagrammatic and fragmentary perspective view of a support system having two acoustic assemblies, each having a respective sonotrode;

FIGS. 40, 41, and 43 are diagrammatic views showing other positions for sonotrodes on the FIG. 39 support system;

FIG. 42 is a diagrammatic and fragmentary perspective view showing the possibility of using a carrier part supporting the sonotrodes;

FIG. 50 is a diagrammatic and fragmentary side view of a sonotrode supporting an anvil for treating a localized zone of a recess;

FIG. 51 is a view analogous to FIG. 50, showing a variant implementation of the invention;

FIG. 52 shows a fragment of a rotor with another example of a shape for a recess.

MORE DETAILED DESCRIPTION

Figure 1:
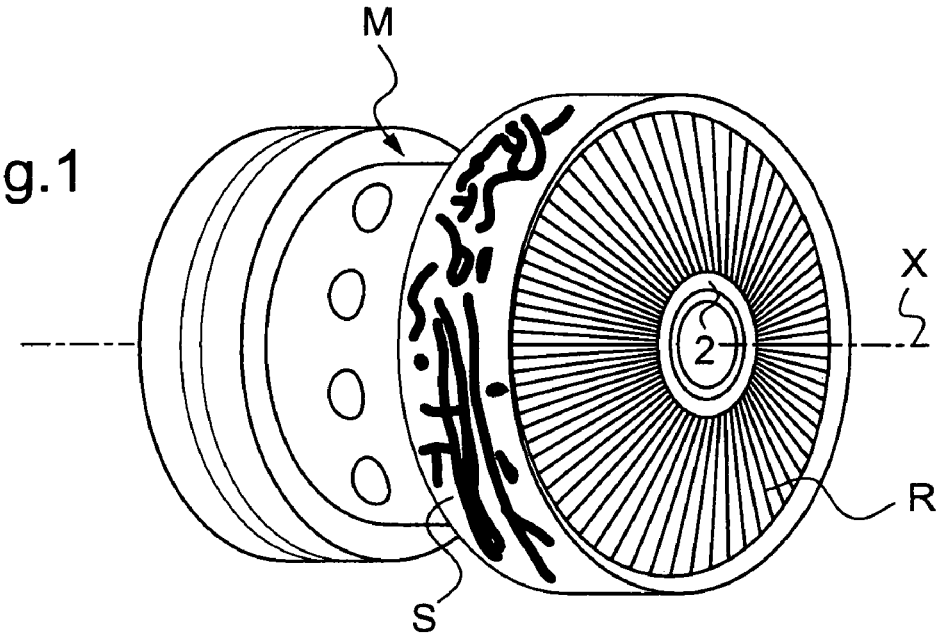
FIG. 1 shows, in partial perspective diagrammatic form, an example of a machine which may undergo a shot peening treatment of the invention.

The rotary machine M shown in FIG. 1 comprises a rotor R that can rotate relative to a stator S about an axis of rotation X.

By way of example, said machine M is a gas or steam turbine, for example an airplane engine, the rotor R of which has not been completely removed from the stator S.

The machine M is in its service environment, for example in a power station or on an airplane wing, when the invention is implemented in situ.

The machine M may also have been dismantled from an aircraft and placed on a cradle, not shown, which may, for example, apply to an airplane engine. The rotor R does not need to have been removed completely from the stator S.

Alternatively, the rotor R may have been removed completely from the stator S, but not completely dismantled.

The machine M may need to be shot peened in a predefined region, for example local shot peening treatment following detection of a crack or defect, or more complete treatment, for example of a leading edge.

In general, the region to be treated may be any region of the rotor R or stator S when the stator is present.

Figure 2:
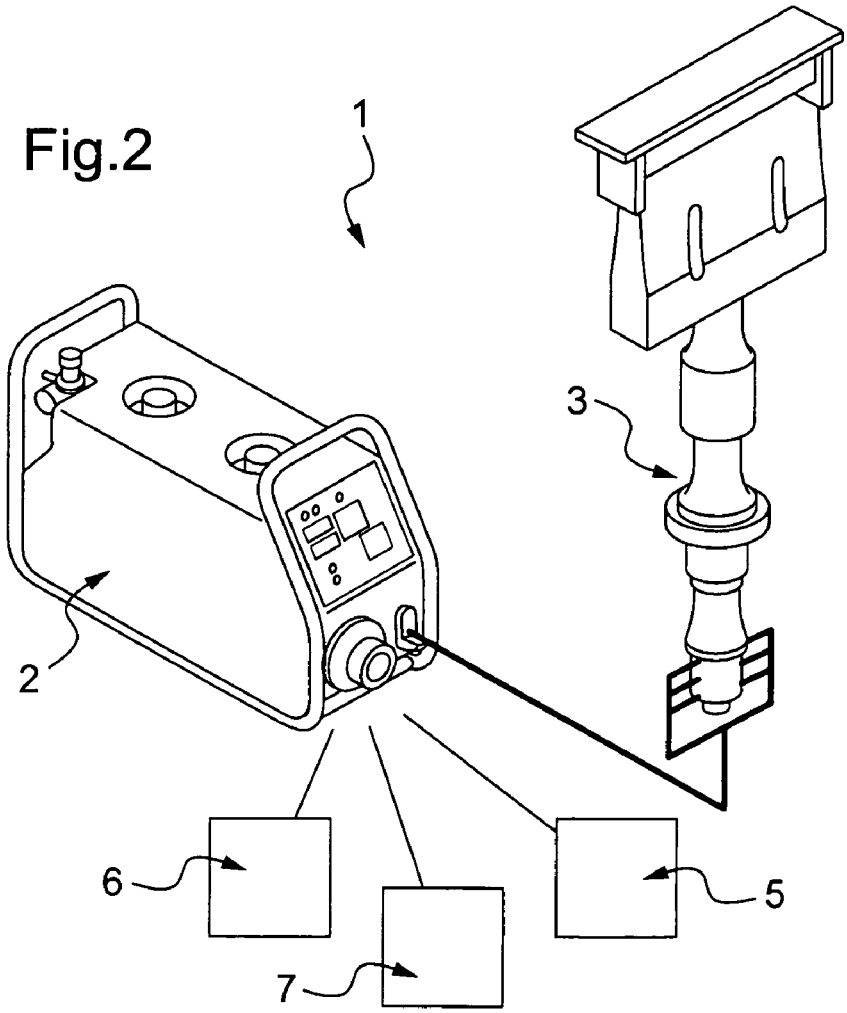
FIG. 2 is a block diagram of an example of a shot peening unit of the invention.

FIG. 2 shows an example of a shot peening unit 1 that can be used to treat a rotary machine such as the machine M shown in FIG. 1.

Said shot peening unit 1 comprises one or more generators 2 which supply one or more acoustic assemblies 3, each comprising one or more sonotrodes.

An acoustic assembly typically comprises a piezoelectric transducer (also known as a converter) which transforms an electric current delivered by the generator 2 into mechanical waves. The vibration amplitude of the piezoelectric transducer is amplified using one or more acoustic stages (also termed boosters) up to the last part of the stack that constitutes the sonotrode and that defines the vibrating surface. The sonotrode may be arranged to vibrate relatively uniformly over the whole of its vibrating surface.

Together with the treated part, the unit defines at least one treatment chamber containing projectiles, for example spherical beads with diameter in the range 0.3 mm [millimeters] to 5 mm. The density of the projectiles is, for example, in the range 2 g/cm$^3$ [grams per cubic centimeter] to 16 g/cm$^3$. The quantity of projectiles is, for example, in the range 0.2 g [grams] to 50 g. The hardness of the projectiles is, for example, in the range 200 HV [hardness Vickers] to 2000 HV.

Where appropriate, the generator 2 may be arranged to control drive means 5 for at least one acoustic assembly 3, as is described below, to displace the acoustic assembly relative to the machine M and to treat an extended region of the machine M.

The unit 1 may include optional means 6 for injecting compressed air into the treatment chamber or towards it, to initiate movement of the projectiles.

The unit 1 may also include detection means 7 that can prevent the operation of the acoustic assembly under certain conditions, for example when there is a risk of accidental departure of projectiles.

The unit 1 may be used to treat various regions of the machine M and, for example as shown in FIGS. 3 to 6, an edge 10 located at the junction of a first surface 11, which is frontal, orientated substantially perpendicular to the axis of rotation X, and a second surface 12, which is cylindrical, concentric with the axis of rotation X.

Said edge 10 may be sharp, chamfered, and/or rayed or it may have undergone a repair treatment by machining and polishing.

In the example shown, the rotor R includes a central bore 21 which may have various profiles and which operates, for example, as a function of the nature of the machine.

In the example shown in FIG. 7, a surface 90 of the bore 21 is being treated, said surface 90 being, for example, a cylinder of revolution about the axis X. The longitudinal axis Z of the acoustic assembly 3 is, for example, orientated perpendicular to the axis of rotation X.

In FIGS. 3 to 7, the acoustic assembly 3 comprises a sonotrode 15 defining a vibrating surface 16 on which projectiles 17 may ricochet and travel back and forth many times during the operation of the acoustic assembly 3 between the vibrating surface and the region to be treated.

The projectiles 17 move in a treatment chamber 18 which is formed by the sonotrode 15, the region to be treated, and the elements 20 for forming a primary chamber.

The elements 20 for forming a primary chamber are produced from a metallic or non metallic material which allows projectiles to ricochet from them, for example steel, INCONEL®, aluminum, or a plastics material, for example a polyamide, a polyacetal, or polyethylene.

The acoustic assembly 3 is mounted on a support system 23 which is fixed on the machine M.

In the example shown, the support system 23 is fixed on the rotor R and more particularly in the central bore 21.

The support system 23 may comprise a first portion 22 which is stationary relative to the rotor and a second portion 25 which can turn relative to the first portion 22 by means of a hinge 28 to allow the acoustic assembly 3 to be displaced relative to the machine M to treat an extended region thereof or to carry out several local treatments.

The first portion 22 of the support system 23 may comprise a mechanism 29 for fixing to the rotor R which may also, where appropriate, allow adjustment of centering to cause the axis of the hinge 28 to coincide with the axis of rotation X of the rotor.

The mechanism 29 may act by radial expansion or otherwise.

Displacement of the acoustic assembly 3 may be carried out manually, for example by the operator manually turning the second portion 25 relative to the first portion 22.

Figure 3:
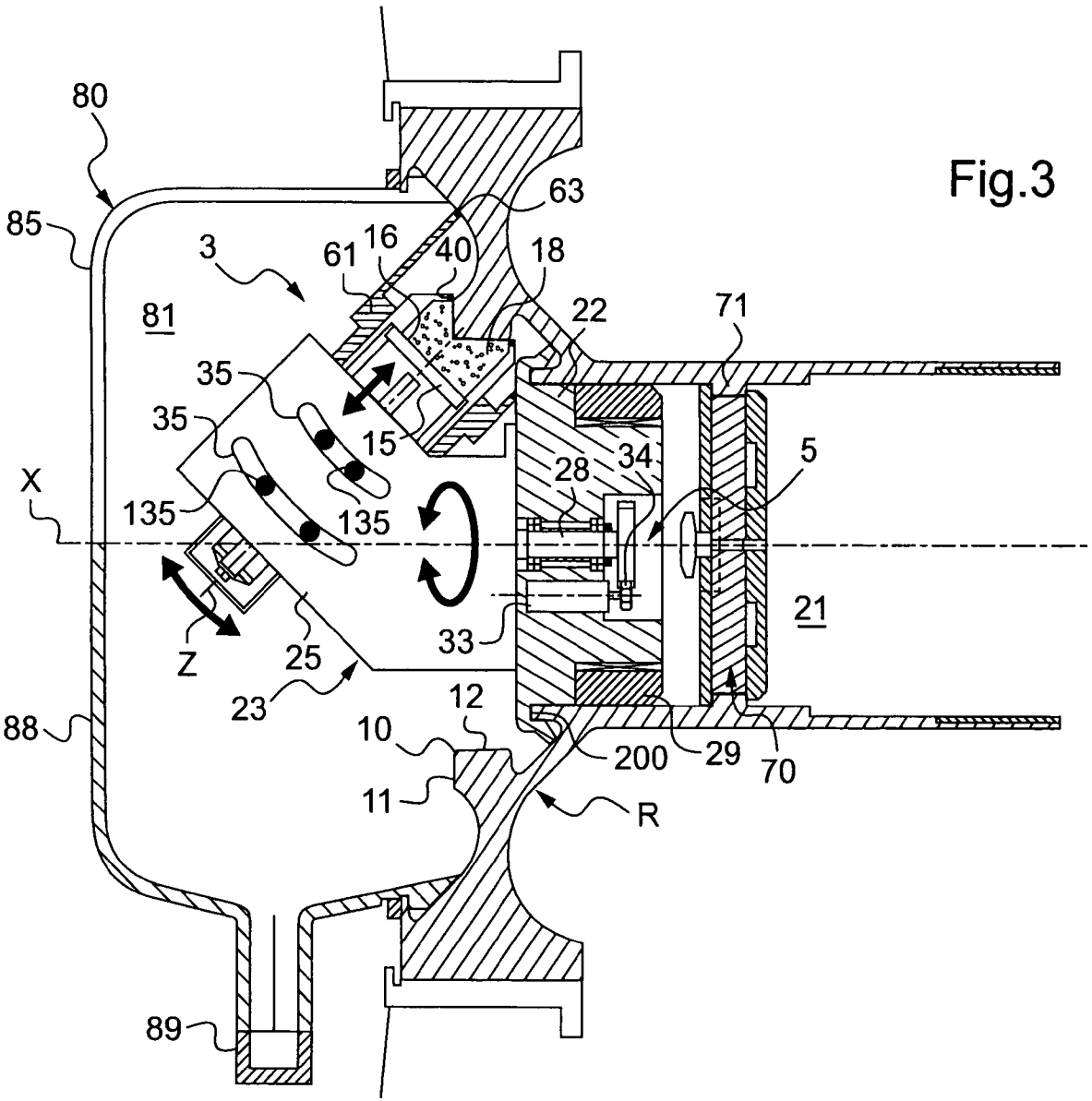

Displacement of the acoustic assembly 3 may also be motorized using the above-mentioned drive means which, for example, comprise at least one motor 33 housed in the first portion 22, as can be seen in FIG. 3.

The second portion 25 supporting the acoustic assembly 3 may, for example, be driven via reduction gearing 34.

Figure 4:
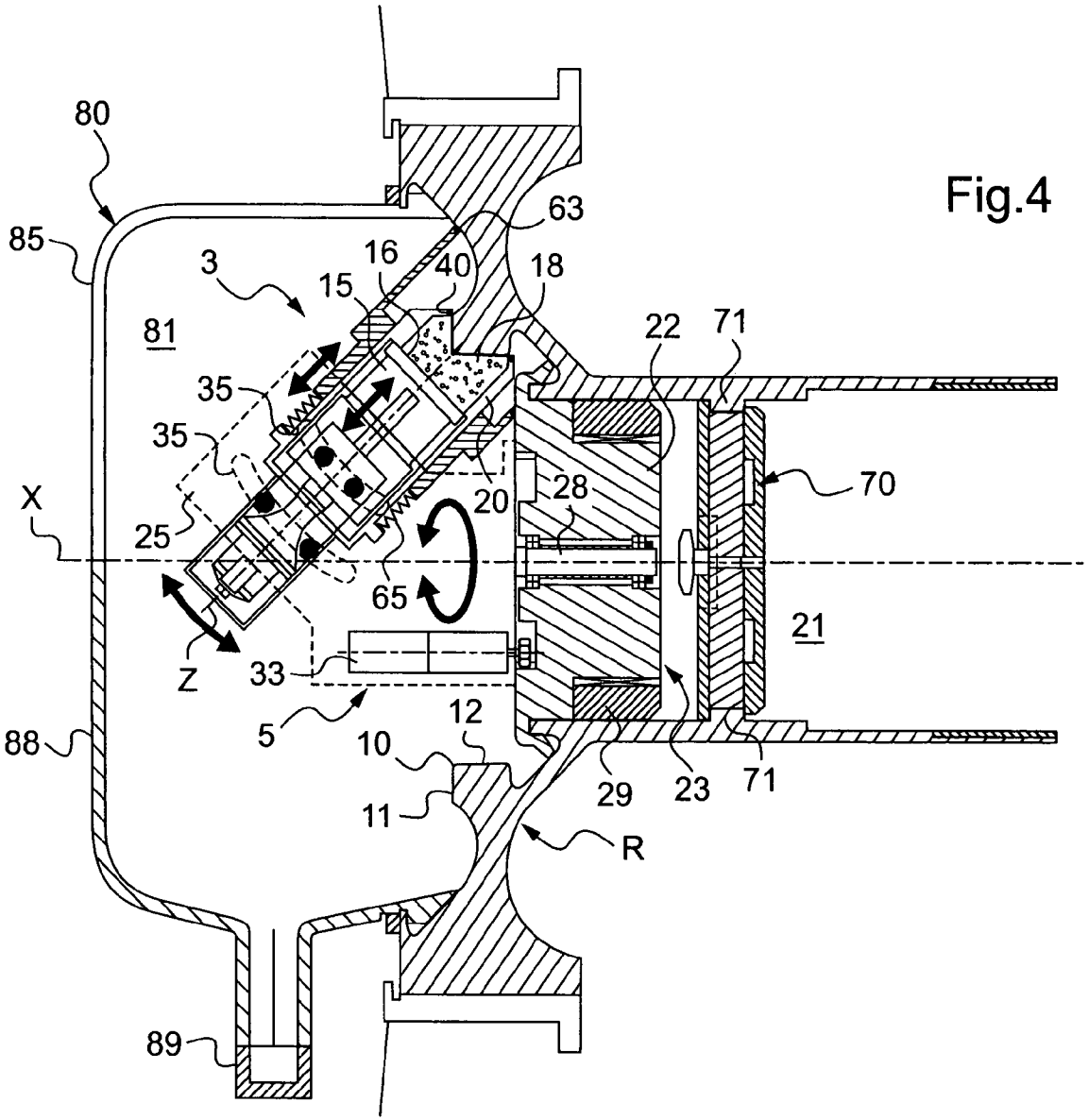
Figure 5:
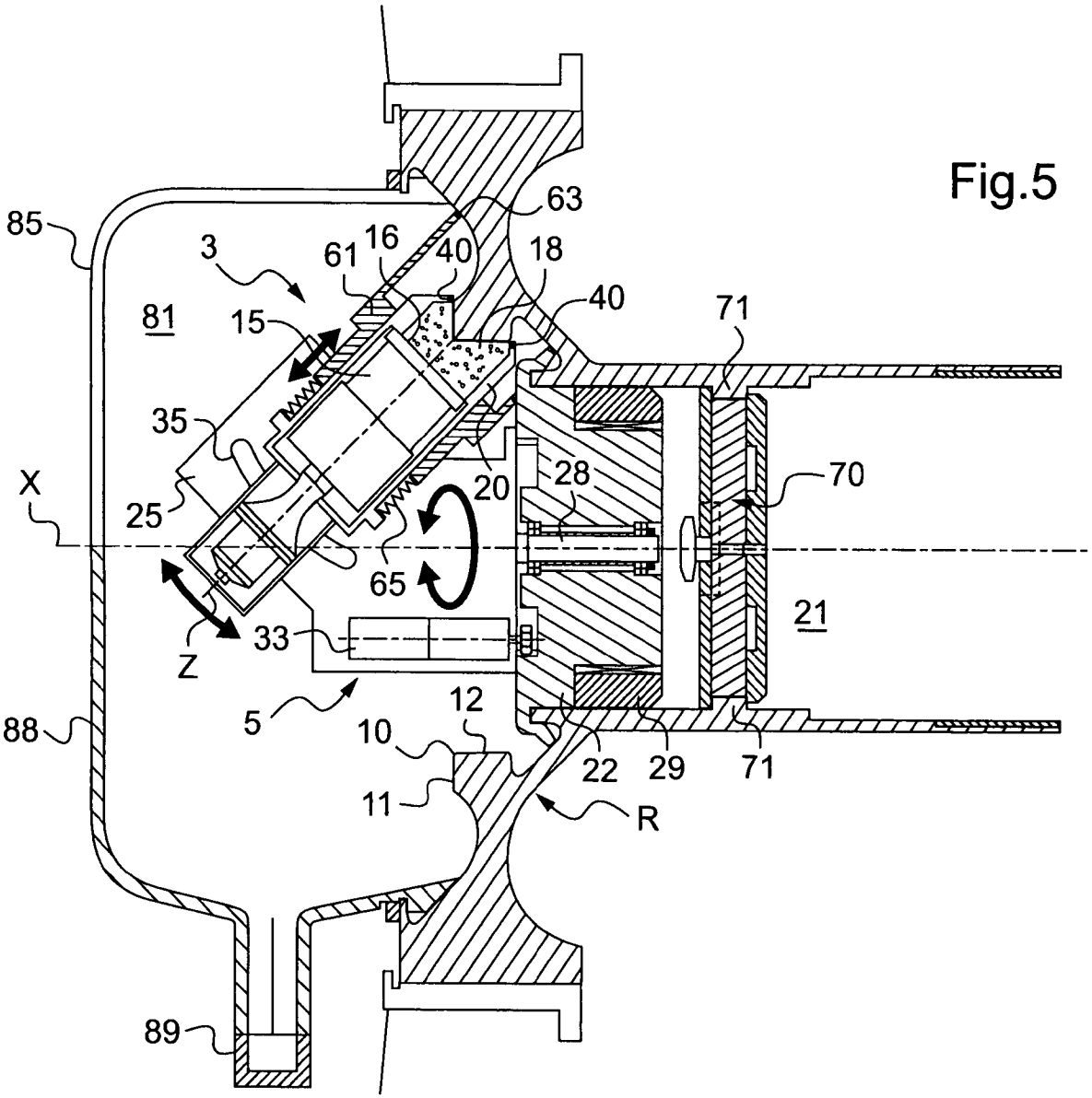
Figure 6:
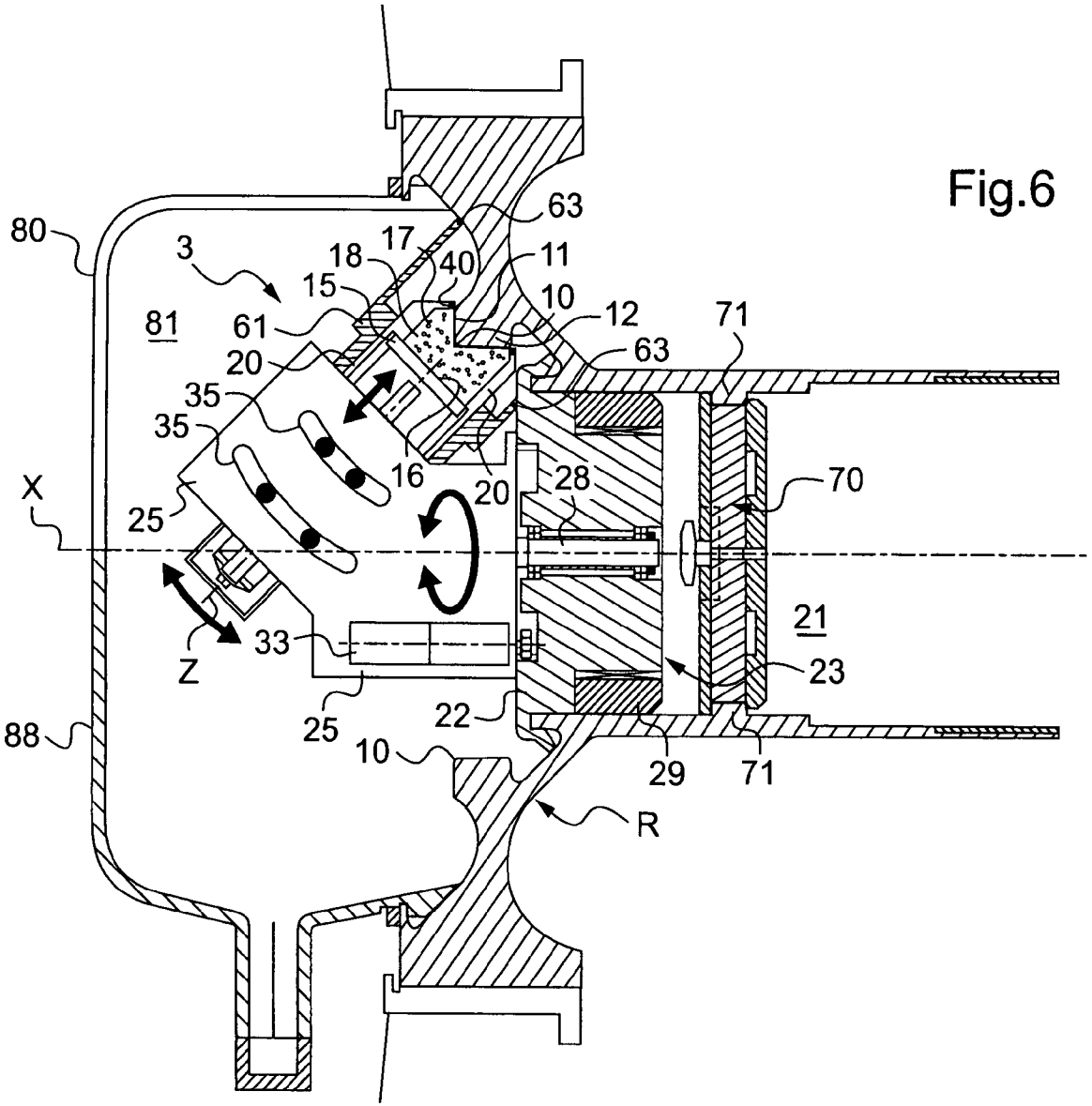

The motor 33 may also be housed in the second portion 25, as shown in FIGS. 4 to 6.

The motor 33 may, for example, be an electric motor powered by the generator 2 in a controlled manner to allow, for example, rotation of the acoustic assembly 3 about the axis of rotation X of the rotor at a predefined speed.

The unit 1 may comprise one or more detectors, not shown, to inform the generator 2 of rotation of the acoustic assembly 3 about the axis X, for example an encoder, which may be optical or magnetic, turning with the shaft of the hinge 28 or with the shaft of the motor 33.

The second portion 25, which supports the acoustic assembly 3, may be produced in a variety of manners as a function, for example, of the shape of the region to be treated.

In a variation, not shown, the drive means 5 comprise a screw or rack allowing axial displacement of the second portion 25 along the axis X.

In the example shown, the second portion 25 allows adjustment of the orientation of the longitudinal axis Z of the acoustic assembly 3 relative to the axis of rotation X, using curvilinear holes 35 and associated fixings 135.

In a variation, not shown, the support system 23 can also allow adjustment of the position of the acoustic assembly 3 along its longitudinal axis Z, for example by means of a rack or a screw.

The elements 20 for forming the primary chamber may come into contact with the treated part or may remain spaced therefrom during operation of the acoustic assembly 3, by a distance which is sufficiently low to prevent the existing clearance to permit the passage of projectiles 17.

The elements 20 for forming the primary chamber may be urged mechanically to bear against the part to be treated by one or more springs, where appropriate.

As indicated above, the unit 1 advantageously includes detection means 5 to detect a breach of security linked, for example, to poor positioning of a mechanical component of the unit.

Said detection means 5 may comprise several detectors located at multiple positions in the unit 1.

In the example under consideration, one or more of the elements 20 for forming the primary chamber comprise detection means 40 which are sensitive to the proximity of the treated part to prevent operation of the acoustic assembly 3 in the event that there is a risk of accidental exit of a projectile from the treatment chamber.

The detection means 40 may, for example, comprise at least one detector disposed at the end of an element 20 for forming the primary chamber and sensitive to the presence of the part to be treated.

As an example, it may be: a contactor, the contactor being actuated by the part to be treated when the element 20 for forming the primary chamber is correctly positioned; or a resistive sensor which is sensitive to electrical contact between the element for forming the primary chamber and the treated part; or an inductive sensor, for example a Hall effect sensor, sensitive to the magnetic field of the part to be treated when it is produced from a magnet material; or a capacitative, or an optical sensor, or otherwise.

The detection means 40 may supply an electric signal to the generator 2, which generator is arranged to indicate a defect in operation to the operator and to prevent operation of the acoustic assembly 3 in the event of poor positioning of at least one of the elements 20 for forming the primary chamber.

The support system 23 may also include detection means, not shown in the figures, which can detect correct positioning of the first portion 22 in the bore 21 of the rotor R.

These detection means may in particular be arranged to detect the position of the support system relative to the rotor to avoid any risk of a projectile passing through the clearance left between the support system 23 and the bore 21 of the rotor.

Said detection means comprise, for example, one or more contactors, not shown, which change state when bearing on the bore or on a rib 200 or the rotor R.

The unit may, as shown, include a secondary chamber 60 formed around the treatment chamber 18 to further reduce the risk of accidental loss of a projectile 17.

Said second chamber 60 may be defined by elements 61 for forming a secondary chamber which may, for example, be applied to the part to be treated M and/or the support system 23.

Said elements 61 for forming a secondary chamber may, where appropriate, include a return system 65, shown in FIGS. 4 to 7, which can ensure constant contact against the part to be treated and/or the support system 23. Said return system 65 may comprise one or more springs.

Like the elements 20 for forming the primary chamber, the elements 61 for forming the secondary chamber may be provided with detection means 63 to detect contact or approach of said elements 61 to the treated part and/or the support system 23.

The unit 1 may be arranged to prevent operation of the acoustic assembly 3 in the case of non detection of sufficient closure of the secondary chamber 60.

The detection means 63 are, for example, selected from resistive, inductive, capacitative, optical or other sensors or contactors.

The detection means 63 may be of the same nature as the detection means 40.

In one aspect of the invention, additional protection means may be employed to further reduce the risk of accidental loss of a projectile.

In the example shown, a safety barrier 70 is positioned in the bore 21 of the rotor behind the support system 23.

Said safety barrier 70 is, for example, arranged to be fixed on a portion in relief of the rotor, for example a rib 71 which projects into the bore 21 of the rotor.

In variations which are not shown, the safety barrier 70 may be arranged to be fixed on another portion in relief of the rotor, for example a groove, or even to be fixed in the bore 21 in the absence of a particular portion in relief thereof.

The safety barrier 70 may be fixed in the rotor R by locking elements 73, for example, which can be rotated, for example as showed in FIGS. 8 and 9, between an unlocked position and a locked position in which they bear on a rear flank of the rib 71, the safety barrier 70 optionally having a collar 74 which bears on a front flank of the rib 71.

The locking elements 73 may be displaced using tab handles 75, for example.

Rather than turning, the locking elements 73 may also be slidably mounted.

As an example, FIGS. 10 and 12 show locking elements 76 which slide in corresponding grooves 77 of the safety barrier 70 and which may be displaced using a cam 78 which is driven in rotation by a tab handle 79.

The locking elements 76 may be displaced against the action of springs 82, as shown in FIG. 13.

FIG. 14 shows another example of a safety barrier 70 in which fixing on the rotor R is carried out by expanding an annular seal 90 lodged between the body 91 of the safety barrier 70 and an end plate 92 into which a rod 93 has been screwed. The rod may be driven in rotation by a tab handle 94.

On turning the tab handle 94, the space between the end plate 92 and the body 91 and thus compression of the seal 90, may be altered, said compression resulting in a radial expansion which ensures that the safety barrier 70 is sealed in the bore 21.

The safety barrier 70 may be independent of the support system 23, as shown.

In a variation, the safety barrier 70 may be linked to the support system 23.

The safety barrier 70 may include detection means that are sensitive to proper positioning of the rotor R in the bore.

Said detection means comprise, for example, a contactor that changes state when bearing against the rib 71. A plurality of contactors may be linked together and circumferentially distributed on the safety barrier 70.

An electric cable, not shown, may connect the detection means of the safety barrier 70 to the support system 23 or the generator 2 so that the generator can prevent operation of the acoustic assembly if the safety barrier 70 is poorly positioned.

The unit 1 may comprise a system 80 for protection against external shocks which defines a space 81 containing the acoustic assembly 3.

The protection system 80 may optionally be impervious to projectiles and may, for example, comprise bars 85, a screen, and/or a shell formed from transparent thermoplastic material or glass.

The protection system 80 may, for example, be fixed on the rotor or the stator, or it may not be fixed to the machine but simply placed in front of it.

The protection system 80 may comprise, in its lower portion, a receptacle 88 for recovering projectiles and provided in its lower portion with a stopper 89 which may be opened to recover the projectiles.

The protection system 80 may be provided with means for detecting its correct position on the machine, said detection means comprising one or more contactors which changes state in contact with the machine M, for example.

FIG. 15 shows a protection system 80 fixed on the machine M by means of a fixing system actuated by one or more tab handles 95.

Said fixing system comprises, for example, one or more elements for pressing tightly against the rotor R or the stator S.

Figure 16:
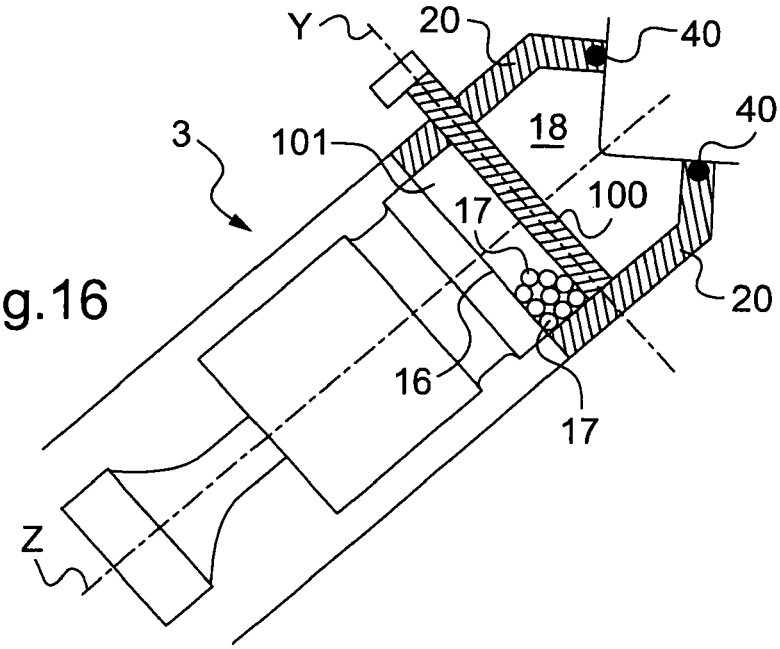
FIG. 16 shows an acoustic assembly provided with a projectile-confinement plug.

As shown in FIG. 16, the acoustic assembly 3 may include closure means 100 that can confine projectiles 17 in a space 101 before operation of the acoustic assembly 3 begins. The closure means 100 comprises a wall 100, for example, which may slide along an axis Y which is, for example, perpendicular to the longitudinal axis Z of the acoustic assembly 3 between a closed position shown in FIG. 16 and a disengaged position in which the vibrating surface 16 of the sonotrode is completely facing the region to be treated.

The closure means 100 may be displaced manually after positioning the acoustic assembly 3 in front of the appropriate region of the machine.

Where appropriate, a locking member controlled by the generator 2 may prevent the closure means 100 from being displaced while satisfactory closing of the treatment chamber 18 and possibly proper positioning of the other components of the unit have not been detected, said locking member being, for example, electromagnetically controlled by the generator 2.

In a further variation, the closure means 100 is displaced in a motorized manner by the generator 2 after verifying that all of the components of the unit are correctly installed.

The invention can treat a rotor including a plurality of peripheral recesses A as showed in FIGS. 17 to 21, for example.

Figure 18:
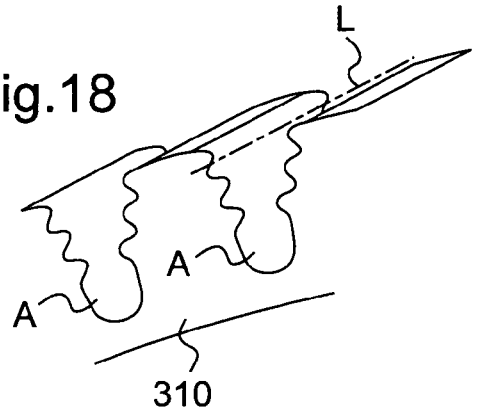
FIGS. 18 to 21 show different recess shapes.
Figure 19:
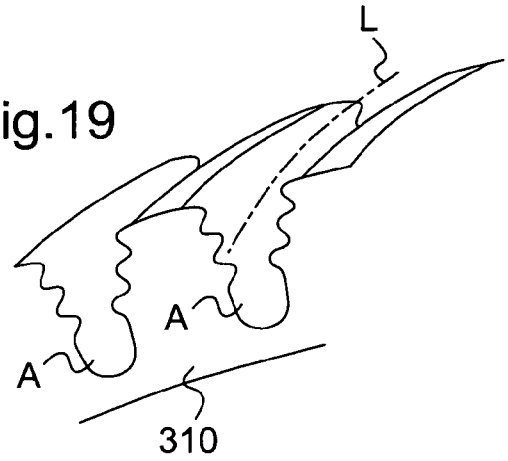
Figure 20:
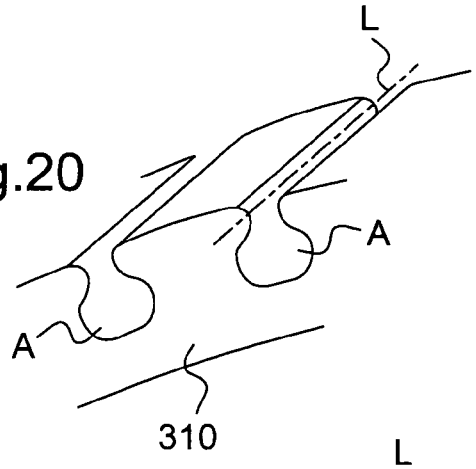
Figure 21:
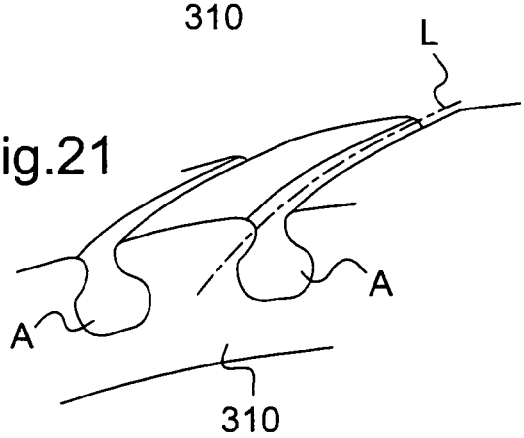

Said recesses A may each have a longitudinal rectilinear axis L, as can be seen in FIGS. 18 and 20, or it may be curvilinear as shown in FIGS. 19 to 21, for example.

The recesses A may have various shapes, for example a shape with a dovetail profile as shown in FIGS. 20 and 21, or with undulating flanks, as can be seen in FIGS. 18 and 19.

Figure 17:
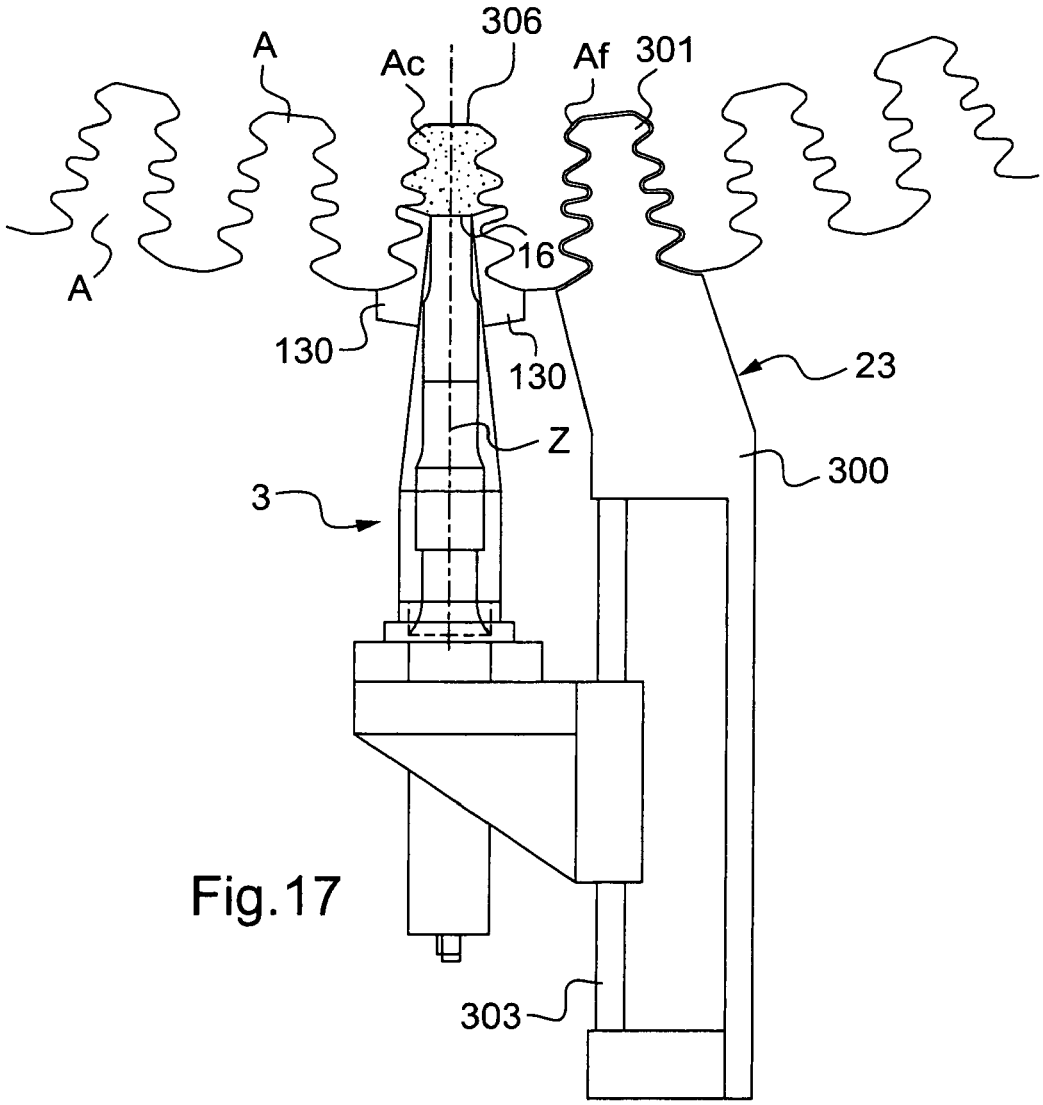
FIG. 17 shows a variation for the treatment of peripheral recesses.

The support system 23 may be fixed in a recess $A_f$ adjacent to the current recess $A_c$ to be treated, as shown in FIG. 17.

To this end, the fixing system 23 may comprise an arm 300 with an end 301 the profile of which is substantially complementary to that of the recess $A_f$.

The fixing system 23 may comprise at least one slide 303 which can displace the acoustic assembly 3 axially along its longitudinal axis Z in order, for example, to adjust the distance separating the vibrating surface 16 of the sonotrode from the bottom 306 of the current recess.

Figure 26:
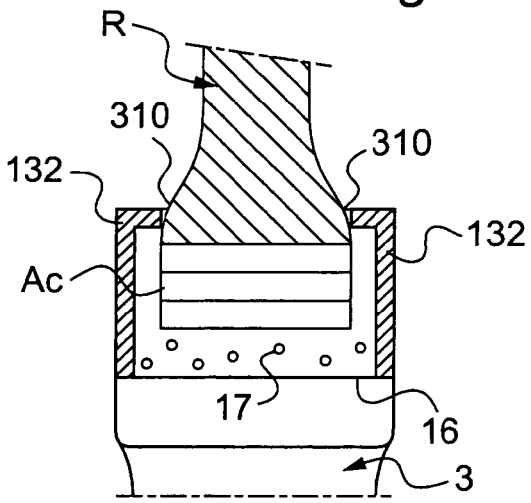

In the example shown, the unit includes elements 132 for forming the primary assembly that can be seen in FIG. 26, which elements axially close the treatment chamber along the longitudinal axis L of the current recess.

Said elements 132 for forming the primary chamber may, for example, be applied against the flanks 310 of the rotor onto which the recesses A open.

In FIG. 26, there can be seen the possibility of the sonotrode being external to the current recess $A_c$.

The acoustic assembly 3 may comprise a sonotrode which extends over the whole length of the recess.

Using a single sonotrode is especially suitable when the longitudinal axis of the current recess $A_c$ is rectilinear.

Figure 27:
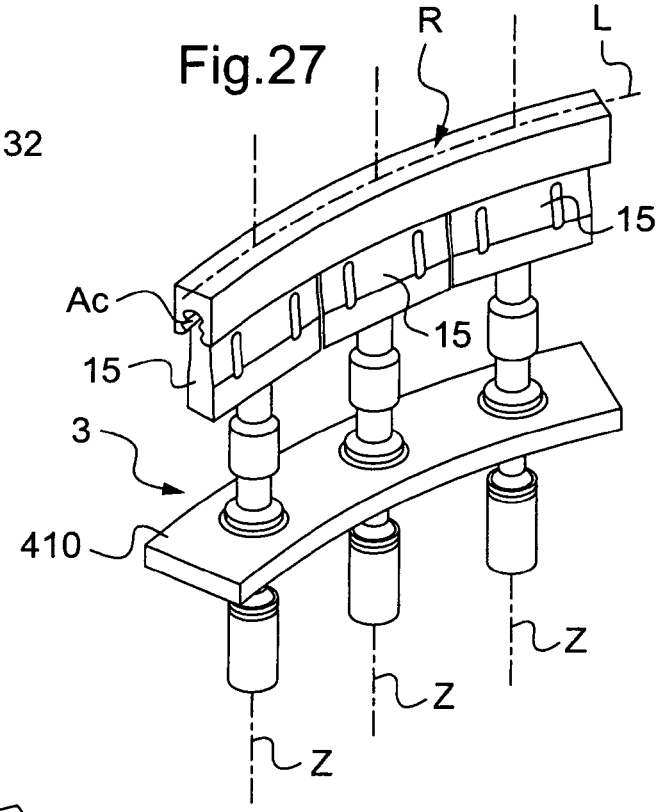
FIGS. 27 and 28 show examples of acoustic assemblies with multiple sonotrodes.
Figure 28:
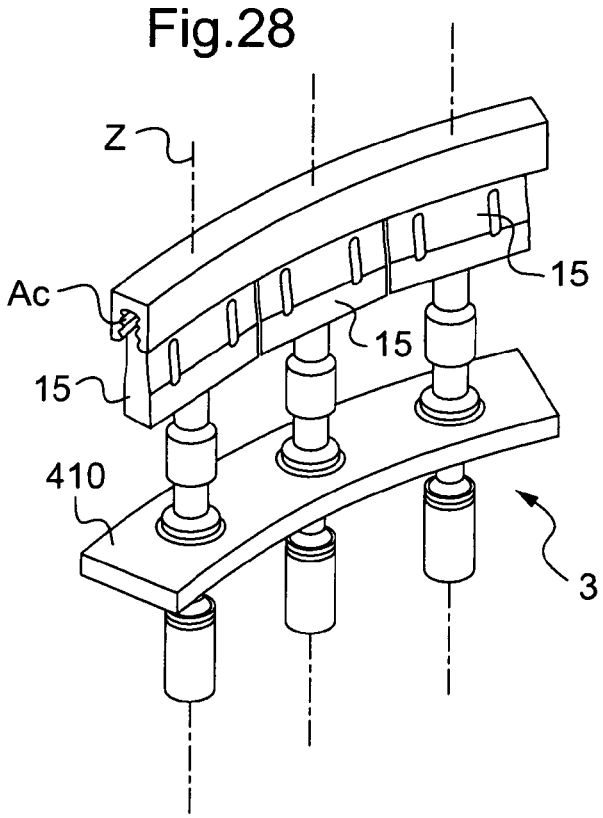
Figure 29:
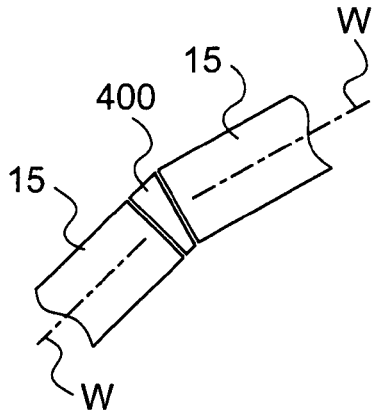
FIG. 29 is a top view along the longitudinal axis of acoustic assemblies, showing a wedge-shaped seal being disposed between two adjacent sonotrodes.

When a recess extends along a curvilinear longitudinal axis L, several sonotrodes 15 may be disposed side by side, as shown in FIGS. 27 to 29, the longitudinal axes Z of the acoustic stacks being non coplanar and mutually parallel, for example.

FIG. 29 shows that the major axes W of the sonotrodes may make an angle between them. A wedge-shaped seal 400 may be disposed between two adjacent sonotrodes 15 to provide surface continuity and prevent projectiles passing between the sonotrodes 15. Using multiple sonotrodes 15 may benefit from treatment of high intensity while being able to treat a complex shape while ensuring that the shapes of the sonotrodes are relatively easy to machine.

Figure 22:
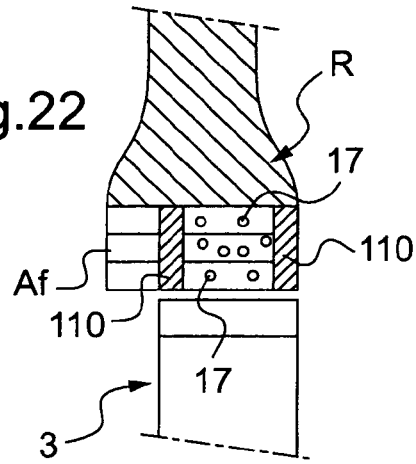
FIGS. 22 to 26 show different shapes for the treatment chambers.

The acoustic assemblies may be fixed via a part 410 having through holes for passing the various stacks. These stacks may be fixed to the part 410 at a vibration node.

Where appropriate, the unit 1 may include chamber-forming elements 110 which define axially, relative to the longitudinal axis L, the treatment chamber inside the current recess $A_c$, as shown in FIG. 22, to prevent projectiles from leaving it.

The acoustic assembly 3 may be kept stationary relative to the recess $A_c$ during treatment thereof. In a variation, the acoustic assembly 3 may be mounted with the possibility of displacement relative to the support system to be able to be displaced relative to the current recess $A_c$.

Such displacement may, for example, allow the sonotrode to be engaged in the recess and to progressively treat it while it is being displaced, and while still following its longitudinal axis L.

Figure 23:
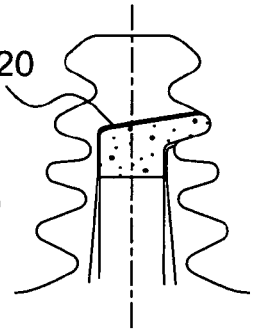

When the sonotrode or sonotrodes are at least partially engaged in the current recess $A_c$, as shown in FIG. 17 or 27 and 28, one or more adapter parts 120 may be introduced with the sonotrode or sonotrodes into the current recess $A_c$ to divert projectiles towards the region to be treated, as shown in FIG. 23.

The treatment chamber may be closed in the current recess $A_c$ by means, for example, of one or more closure elements 130 which are applied to the flank or flanks of the current recess, as shown in FIG. 17.

Figure 24:
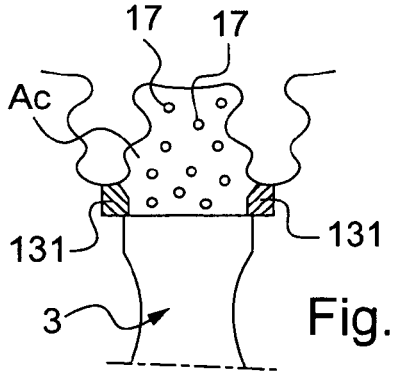
Figure 25:
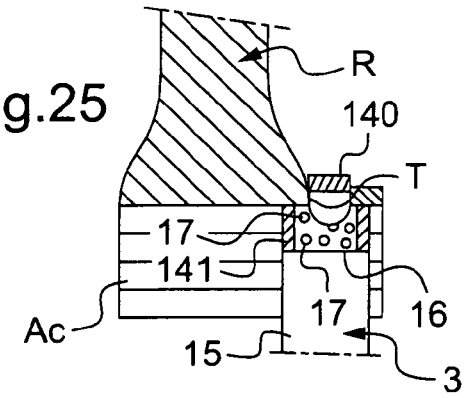

When the sonotrode remains outside the current recess, the treatment chamber may be defined by closure elements 131, e.g. for pressing against the rotor surface between the recesses, as shown in FIG. 24.

When the current recess $A_c$ includes a hole T, it may be plugged by a plugging element 140 which may be located in a variety of manners in the hole T, for example from the current recess or via the hole of an adjacent recess.

Where appropriate, the plugging element 140 includes detection means which can detect its correct positioning in the hole T. These detection means comprise, for example, a contactor that changes state when the plugging element 140 bears against the wall of the hole T or an adjacent wall. The generator 2 may be arranged to prevent the operation of the acoustic assembly or assemblies 3 in the event that it detects that the plugging element 140 is not positioned properly.

The treatment chamber may be defined by elements 141 for forming a primary chamber, which can define the treatment chamber around the hole T.

In all of the above examples, before operating an acoustic assembly 3, its vibrating surface 16 may be orientated upwardly or downwardly.

When the vibrating surface 16 is orientated upwardly, the projectiles 17 may reach the vibrating surface 16 under gravity, which can initiate their motion.

When the vibrating surface is orientated downwardly or obliquely, at least one air jet may be directed towards the projectiles 17 to initiate their movement and bring them into contact with the vibrating surface 16.

Any of the examples described above may include a means 6 for injecting air comprising, for example, a pressurized air inlet channel admitting air into an element for forming the primary chamber, for example, or elsewhere.

Air injection may be controlled by the generator 2, which has, for example, an outlet which can control a solenoid valve for admitting compressed air into the treatment chamber for a predefined period after starting operation of the acoustic assembly.

Where appropriate, a jet of air may be delivered constantly into the treatment chamber in order, for example, to cool one or more of the components of the unit.

A unit of the invention may include counter means for counting the projectiles before operating the acoustic assembly and after the treatment has been carried out.

Said counter means comprise, for example, a suction duct opening into the treatment chamber, via which the projectiles may be sucked in, said projectiles passing in front of a detector suitable for counting them, for example an optical sensor.

The invention is not limited to a particular shape of rotor or stator, nor to a particular region of the machine undergoing shot peening.

Figure 30:
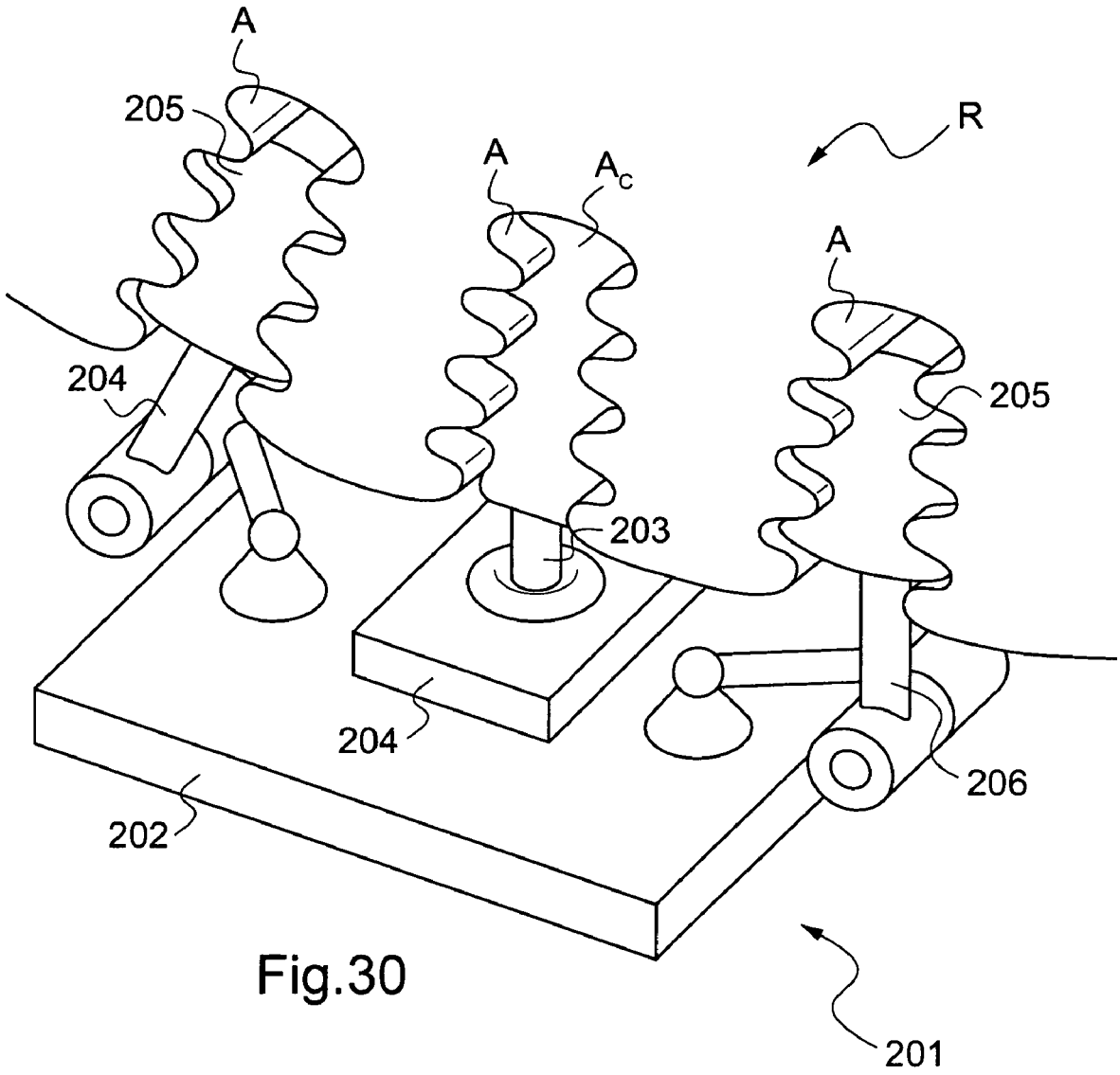
FIG. 30 is a diagrammatic and fragmentary perspective view showing an example of a shot peening device in accordance with the invention.

The device 201 shown in FIG. 30 is a device for shot peening the rotor R of a rotary machine M that is shown in part only.

The rotor R can turn relative to a stator that is not shown.

The machine M is constituted, for example by a gas or steam turbine, e.g. an airplane engine having a rotor R that has not been extracted completely from its stator. By way of example, the machine M may be in place in its utilization environment, e.g. in a power station or on an airplane wing, in which case the invention is implemented in situ. The machine M may also have been removed from an aircraft and placed on a cradle (not shown), as can apply for example with an airplane engine. The rotor R need not be extracted completely from the stator. The rotor R could alternatively be extracted completely from the stator, while not being disassembled.

The machine M may require shot peening in a predefined region, for example local shot peening treatment after detecting a crack or a defect. The intention may be to shot peening recesses A situated in the periphery of the rotor. These recesses A are for receiving blades.

The shot peening device 201 has one or more vibration generators that excite one or more acoustic assemblies, each comprising one or more sonotrodes, which sonotrodes are not shown in FIG. 30 in order to clarify the drawing.

By way of example, an acoustic assembly comprises a piezoelectric transducer, also referred to as a converter, that transforms an electrical current delivered by the generator into a mechanical wave. The amplitude of the vibration of the piezoelectric transducer is amplified with the help of one or more acoustic stages, referred to as "boosters", up to the last part of the stack constituting the sonotrode and defining the vibrating surface at an end face of the sonotrode. The sonotrode may be arranged in such a manner as to vibrate in relatively uniform manner over the entire vibrating surface on an end face of the sonotrode.

Together with the treated part, the device defines at least one treatment chamber containing projectiles, e.g. spherical beads with a diameter lying in the range 0.3 mm to 5 mm. The density of the projectiles may lie, for example, in the range 2 g/cm$^3$ to 16 g/cm$^3$. By way of example, the quantity of projectiles may lie in the range 0.2 g to 500 g. The hardness of the projectiles lies in the range 200 HV to 2000 HV, for example.

The device may include a control system arranged, where appropriate, to control means for driving at least one acoustic assembly, in order to move the acoustic assembly relative to the machine M and, for example, to enable a plurality of rotor recesses to be treated.

Optionally, the device may include means for injecting compressed air into the treatment chamber or towards the treatment chamber in order to initiate movement of the projectiles, where necessary.

The device may also include detection means that can prevent the acoustic assembly from operating under certain conditions, for example when there is a risk of projectiles accidentally departing.

In the example shown in FIG. 30 in particular, the shot peening device 201 comprises a support system 202 supporting an acoustic assembly 203, shown in part in this figure, and a base 204 serving, where appropriate, to enable the acoustic assembly to be moved relative to the support system 202, e.g. so as to follow the shape of a recess, where the recesses may extend in rectilinear or curvilinear manner across the thickness of the rotor.

The support system 202 carries at least one connection arm, and in particular two connection arms 206. Each of these arms carries a respective connection part 205.

The connection parts 205 are arranged to enable each of them to be fastened in a recess A, with the recesses A that receive these connection parts 205 in the example shown being situated respectively on either side of the current recess for treatment that is referenced Ac. Each recess has walls presenting portions in relief for connecting blades, where these portions in relief can have a variety of shapes, for example they may be of dovetail shape, or of some other shape.

In this example, the support system 202 is thus fastened to the rotor R by the connection arms 206. In the embodiment shown in FIG. 30, the connection arms 206 are movable relative to the support system 202.

As can be seen in greater detail in FIG. 31, the acoustic assembly 203 comprises a sonotrode 207 with an end face that constitutes the vibrating surface 208.

The treatment chamber 209 is defined firstly by the walls of the recess Ac for treatment and secondly by partitions 210 situated on either side of the vibrating surface 208 and extending perpendicularly thereto.

As shown in FIG. 31, the shot peening device 201 may also include guides 211 enabling the sonotrode to be guided inside the current recess Ac for treatment. The partitions 210 of the treatment chamber 209 are of a shape that substantially matches the shape of the recess, e.g. leaving clearance that is less than or equal to half the diameter of the projectiles.

FIG. 32 shows an example of a fastener system for a connection arm 206 using one or more connection parts 205. The fastener system comprises a clamping system acting on the or each connection part of the or each arm so as to lock the connection part that is engaged in the recess A.

In this example, the connection parts 205 bear against surfaces of the side walls of the recesses A that extend substantially transversely to the axis K passing through the bottom of the recess and through its opening. The connection parts 205 comprise a top jaw 205*a* and a bottom jaw 205*b*, where the jaws 205*a* and 205*b* are suitable for being moved towards each other or away from each other, e.g. by means of a screw and nut system depending on whether the connection part 205 is to be withdrawn from the recess A or is to be fastened therein so as to hold the support system 202 in place.

Figure 33:
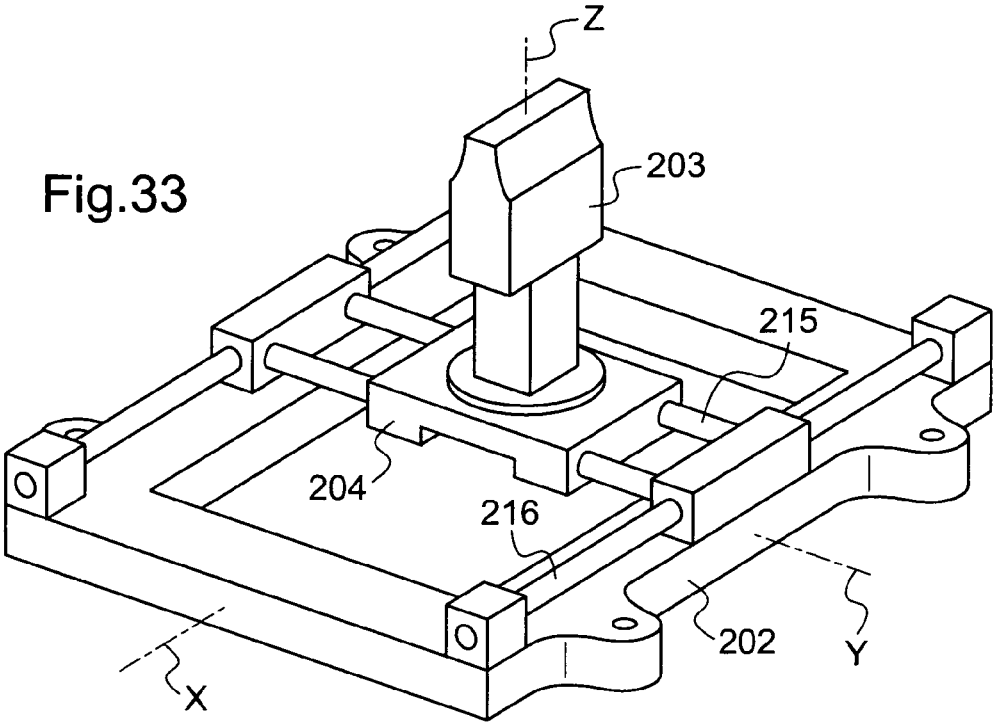
FIG. 33 is a diagrammatic and fragmentary perspective view showing a support system for the acoustic assembly.

FIG. 33 shows in greater detail an example of the support system 202 and the base 204 that is movable relative to the support system. The base 204 is mounted on rails 215 that enable it to slide along an axis Y, and on rails 216 perpendicular to the rails 215 that enable it to slide along an axis X perpendicular to the axis Y. In the example shown, the acoustic assembly 203, and in particular the sonotrode 207, is also movable in rotation about an axis Z perpendicular to the axes X and Y.

The acoustic assembly 203 may be capable of moving freely in rotation and/or transversely on the support system 202, e.g. with the acoustic assembly 203 being turned or moved relative to the support system solely under pressure from the guides 211, for example. In a variant, the movement may be motor driven, e.g. on the basis of knowledge about the profile of the recess for treatment or with the help of sensors inserted therein.

In a variant that is not shown, the base 204 is stationary relative to the support system 202.

In another variant that is not shown, the support system 202 need not include a base 204 that is slidably movable on rails as shown, but may for example include a manipulator arm that supports the acoustic assembly and that can modify the orientation of the sonotrode relative to the axes X, Y, and Z.

To implement the shot peening method of the invention, it is possible to fasten the connection arms 206 of the support system 202 in at least two recesses A situated respectively on either side of the current recess Ac for treatment; the current recess Ac is subjected to shot peening by means of the acoustic assembly 203 secured to the support system 202. The entire recess Ac may be treated, or only a portion thereof, e.g. a hole. Thereafter, the support system can be removed, i.e. the arms 206 undone, and then the support system 202 and/or the rotor R can be moved relative to each other so as to fasten the support system 202 on two other recesses A situated respectively on either side of a new recess for treatment.

Figure 34:
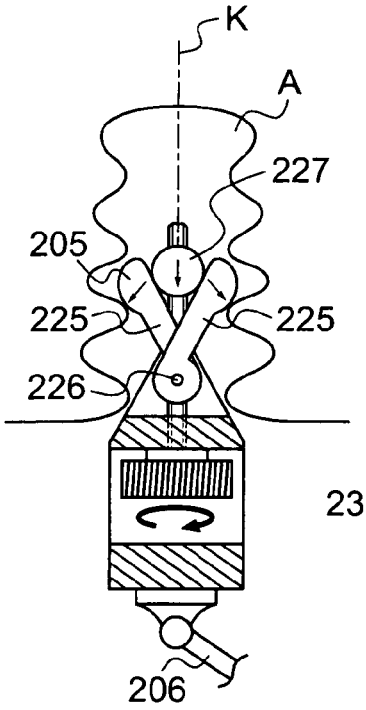
FIGS. 34 to 36 are diagrammatic and fragmentary axial sections of other connections between of an arm of the support system in a recess.
Figure 35:
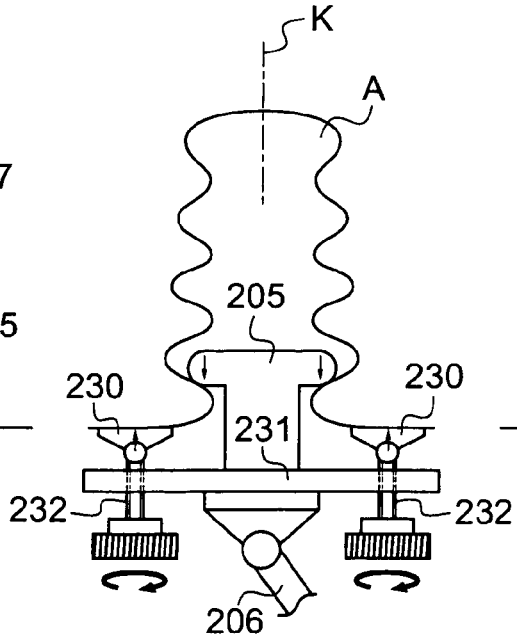
Figure 36:
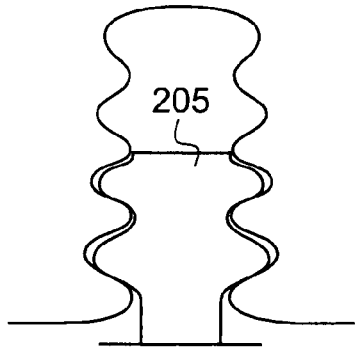

FIGS. 34 to 36 show other examples of connection parts 205.

In FIG. 34, the connection part 205 comprises two branches 225 that are secured to and movable in rotation about a pivot axis 226, together with a part 227 acting as a wedge and secured to a rod that extends along the axis K.

The part 227 can be moved along the rod along the axis K, e.g. so as to be inserted between the facing faces of the branches 225 and so as to bear against them and urge them away from each other, with the free ends of the branches 225 then bearing against the walls of the recess, thus enabling the support system 202 to be locked and secured. In the examples shown in FIGS. 32 and 34, one or more connection parts of one or more connection arms engaged in respective recesses are locked by means of a system for clamping the connection part(s). Each of the connection parts 205 bears against two facing portions in relief of the side walls of the recess.

In the variant shown in FIGS. 35 and 36, one or more connection parts of one or more connection arms engaged in respective recesses A are locked by means of a counter-thrust system bearing against the rotor other than in the recess A, e.g. against the periphery of the rotor, e.g. on either side of the recess A. The connection parts 205 may bear firstly against a surface of a portion in relief on the side wall of the recess that faces towards the bottom of the recess, and secondly against a surface situated outside the recess, e.g. at two locations on either side of the recess.

In FIG. 35, the support system 202 is connected with the help of a connection part 205 suitable firstly for bearing against a portion in relief of the wall of the recess A, and secondly for bearing against the rotor with the help of counter-thrust pads 230 situated on either side of the recess A, these pads 230 comprising for example screws 232 that screw through a plate 231 extending substantially perpendicularly to the axis K. The connection part 205 coming to bear against a portion in relief in the recess is held stationary relative to the plate 231. The screws 232 can be turned, so as to bear on either side of the recess A, thus moving the plate 231 away from the recess A and thereby locking the connection part 205 against the portion in relief in the recess A, as shown.

In the example shown in FIG. 36, the connection system (not shown) is the same as that of FIG. 35. The connection part 205 nevertheless presents a shape that differs somewhat from that of FIG. 35 so as to match the shape of the recess A more closely. Thus, the connection parts 205 can bear against two portions in relief situated at different heights up the side wall of the recess (and not only against one, as in the example of FIG. 35).

Figure 37:
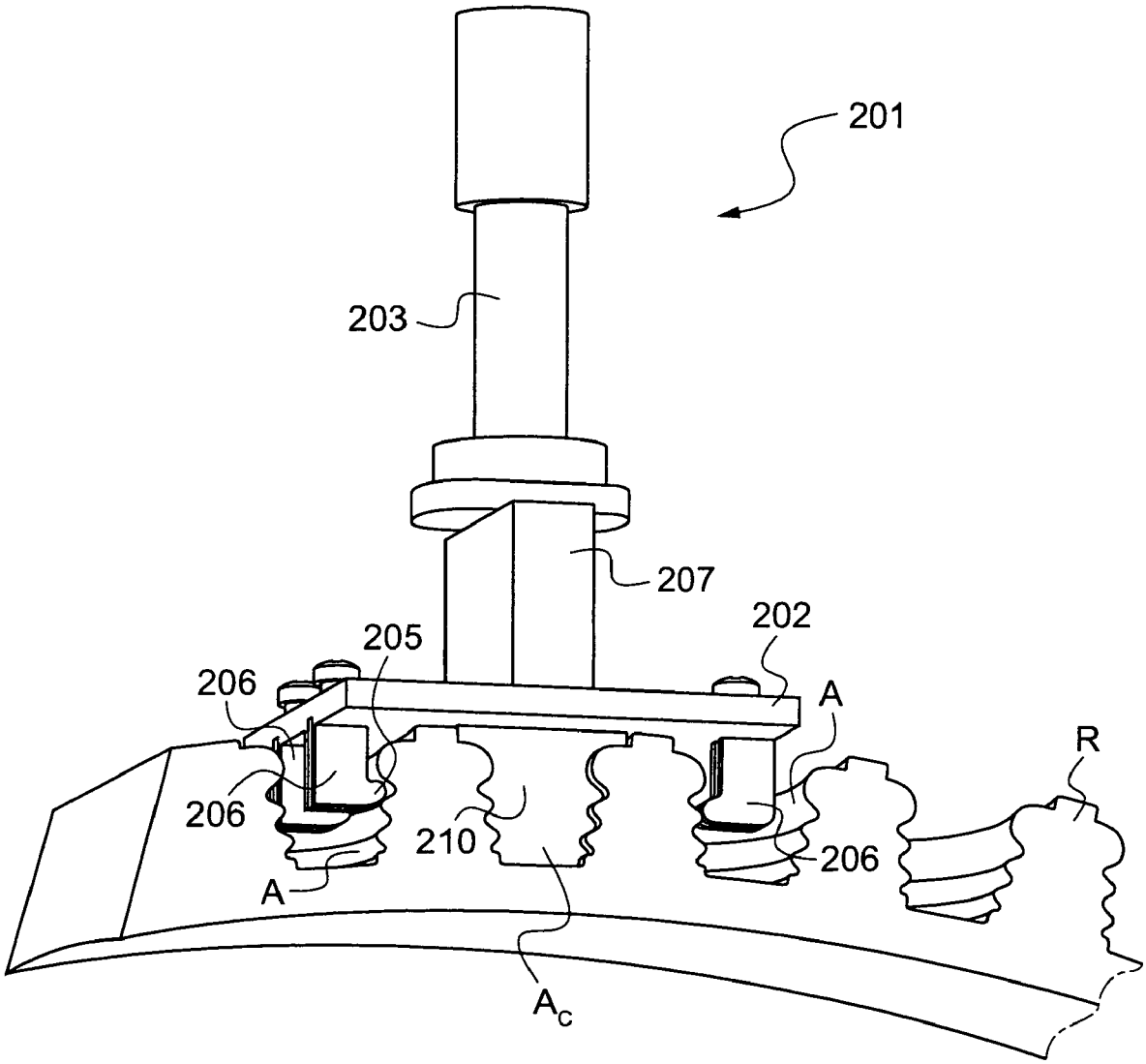
FIG. 37 is a diagrammatic and fragmentary section view of an other example of a connection of the support system on the rotor.

As shown in FIGS. 32 and 34 to 36, the connection arms 206 may include connection parts that are arranged to wedge in the corresponding recesses by a change of shape. In a variant, the connection arms can be locked to the rotor by acting on the spacing between the arms, for example. FIG. 37 shows such locking that is performed by means of a clamping system acting on the connection part. The support system 202 has a base 204 arranged in such a manner as to enable the connection arms 206 to move towards each other. The connection arms 206 can move by sliding on the base 204, for example, so as to come to bear against the side walls of the recesses and thus connect the support system 202.

Figure 38:
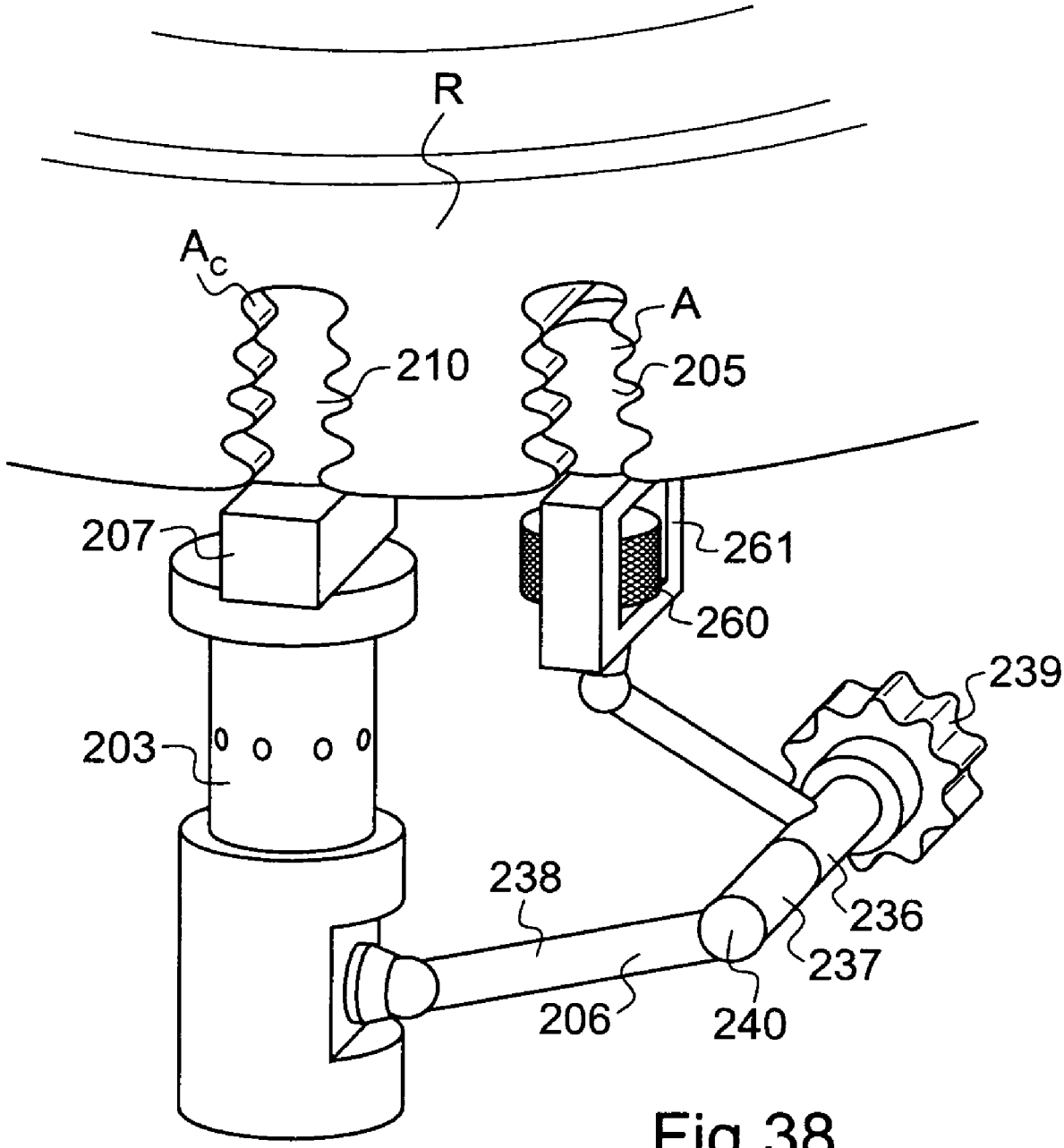
FIG. 38 is a fragmentary and diagrammatic perspective view showing another embodiment of a connection arm of the invention.

In FIG. 38, there can be seen another example of a connection arm 206. This arm comprises a first arm portion 235 connected to a first hinge portion that can be turned relative to a second hinge portion 237 about an axis 240, the second hinge portion being connected to an arm portion 238 that is fastened at its other end to the acoustic assembly 203 via a lockable ball joint. The first arm portion 235 is also fastened via a lockable ball joint to the connection part 205. The arm 206 as a whole is fitted with an internal system for locking the joint. This system, as shown in FIG. 38, can be activated by turning a knob 239 that could be replaced by a pneumatic, hydraulic, or mechanical actuator of some other shape.

In the example shown, the connection part 205 is fastened by means of a counter-thrust system, e.g. comprising a thumbwheel 260 and a nut 261 bearing against the periphery of the recess A to lock the connection part 205 in place. Turning the thumbwheel 260 enables the connection part to be moved relative to the nut 261.

The support system 202 may carry a single acoustic assembly 203 with one sonotrode 207. In a variant, the support system may carry a plurality of acoustic assemblies 203, each carrying a respective sonotrode 207, as shown in FIGS. 39 to 46. A plurality of sonotrodes, in particular when they are placed side by side, can enable the entire current recess Ac to be treated, where so desired.

FIG. 39 shows the possibility of placing two sonotrodes 207 side by side, which sonotrodes are fastened on a base 204 that can be movable relative to the support system 202, as described above.

In the example shown in FIG. 39, two sonotrodes 207 are disposed side by side and the vibrating surfaces 208 extend along a rectilinear axis L.

In FIG. 40, there is shown the possibility of the vibrating surfaces 208 constituting the end faces of the sonotrodes forming between them a non-zero angle $\gamma$, e.g. for treating an edge.

Another disposition for the sonotrodes 207 may consist in placing the vibrating surfaces 208 in a common plane, but so that they extend longitudinally along two respective axes S1 and S2 that are mutually perpendicular, as shown in FIG. 41.

In the example shown in FIG. 42, each of the two acoustic assemblies supports a carrier part 241, itself carrying a plurality of sonotrodes 207, and more specifically two sonotrodes. The carrier part 241 serves to fasten a plurality of sonotrodes on a common acoustic assembly. Naturally, it would not go beyond the ambit of the invention for the support system to have a single acoustic assembly carrying a carrier part, in turn supporting a plurality of sonotrodes. The sonotrodes may present end faces of generally rectangular shape, as shown in FIGS. 39 to 41.

In a variant shown in FIG. 43, the sonotrode(s) may have respective vibrating surfaces that extend along curvilinear axes, e.g. for treating a curvilinear recess. Under such circumstances, the general shape of the end face of the sonotrode is not rectangular, but presents at least two curvilinear edges 244.

Figure 44:
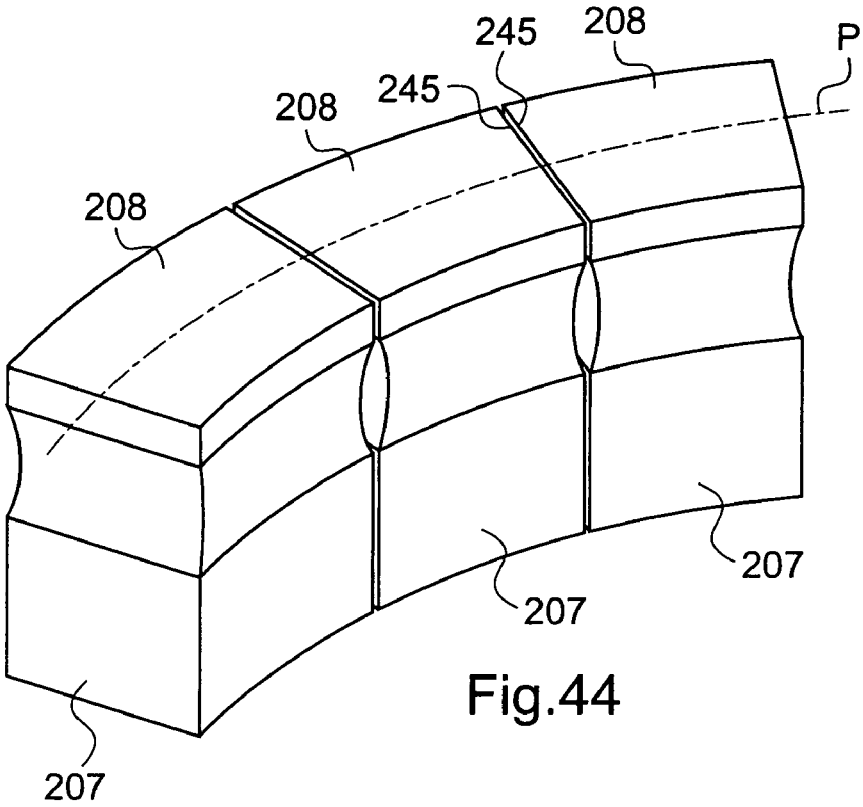
FIG. 44 is a diagrammatic and fragmentary perspective view showing the arrangement of a plurality of sonotrodes.
Figure 45:
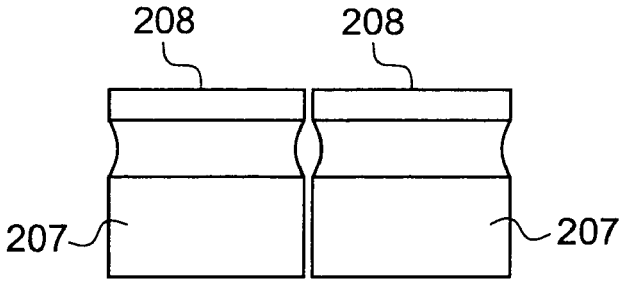
FIG. 45 is a diagrammatic and fragmentary side view of the sonotrodes of FIG. 44.
Figure 46:
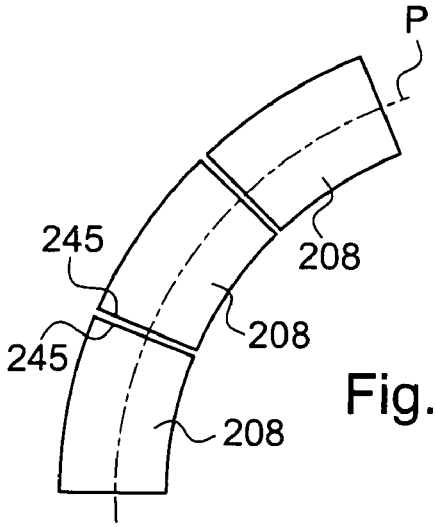
FIG. 46 is a diagrammatic and fragmentary plan view of the sonotrodes of FIG. 44.

FIG. 44 shows in isolation a plurality of sonotrodes 207. Each of these sonotrodes extends along a curvilinear axis P, as can also be seen in FIG. 46. The sonotrodes 207 are disposed side by side, and by way of example, the edges 245 adjacent to the vibrating surfaces are rectilinear and placed mutually parallel, as can be seen in FIGS. 45 and 46, in particular.

Figure 48:
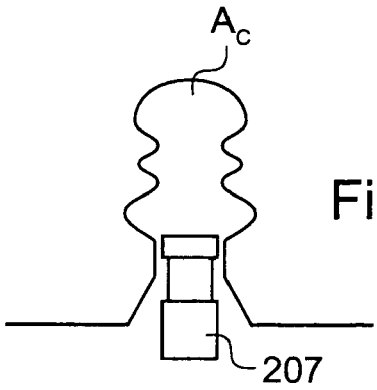
FIGS. 48 and 49 are diagrammatic and fragmentary side views showing two different positions for a sonotrode inside a recess for treatment.
Figure 47:
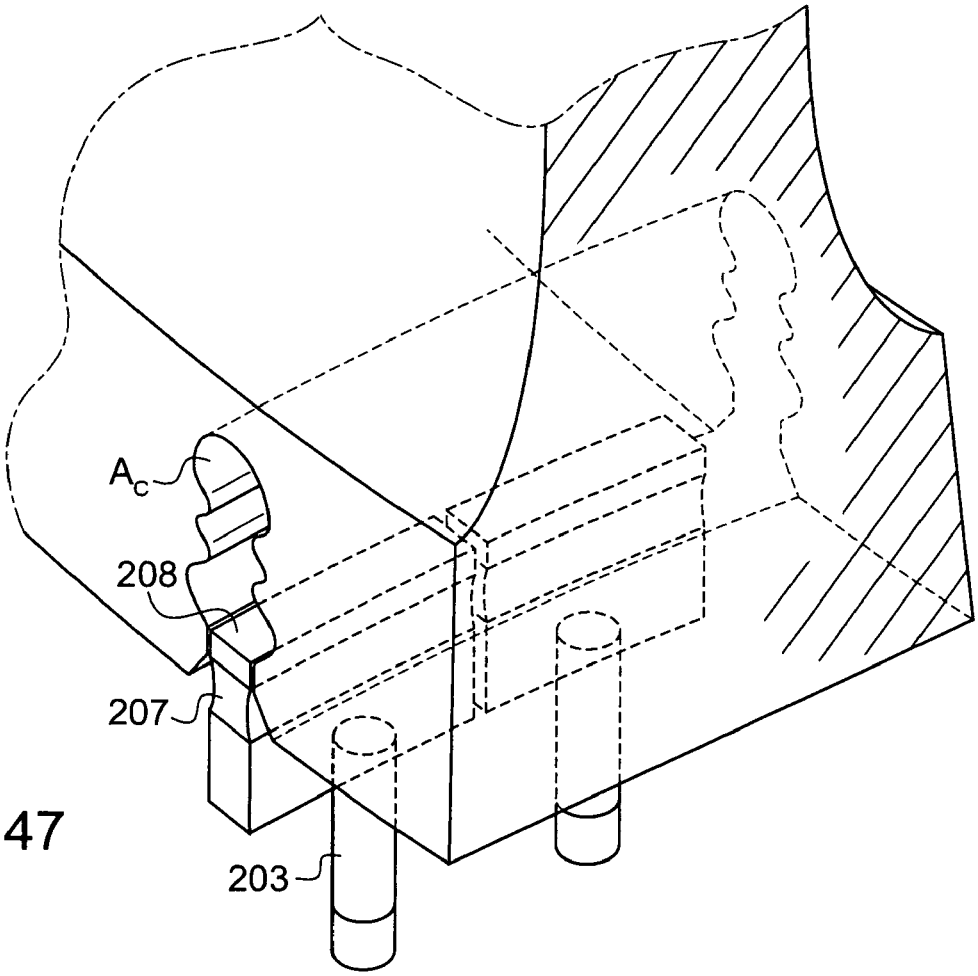
FIG. 47 is a diagrammatic and fragmentary perspective view showing an example of inserting a sonotrode inside a recess for treatment.
Figure 49:
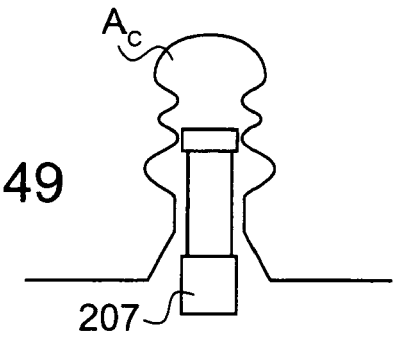

FIGS. 47 to 49 show the possibility of inserting the acoustic assembly(ies), in particular the sonotrodes 207, at least in part into the recess Ac for treatment. As can be seen in FIGS. 48 and 49, it is possible to introduce the sonotrode(s) to a greater or lesser depth into the inside of the current recess Ac for treatment, depending on treatment requirements. It is also possible to move the sonotrodes 207 inside the recess to a greater or lesser depth during a single treatment operation, e.g. interrupting the shot peening activity while the sonotrode(s) is/are moved. Inserting the sonotrode(s) into the inside of the current recess for treatment can serve to concentrate the shot peening effect, e.g. when the recess is very large, in particular in zones of the part that are the most critical.

It is also possible to concentrate the projectiles in a single zone, e.g. when performing localized repairs, as shown in FIGS. 50 and 51. In this example, the sonotrode is surmounted by an anvil 250, enabling the projectiles 251 to be directed towards a zone 252 for treatment, which zone forms a hole in the example shown. Naturally, the invention is not limited to the above description.

The sonotrode(s) can be excited other than by piezoelectric vibration, e.g. by pneumatic, electromechanical, or other vibration.

The recesses A may have side walls presenting connection portions in relief of a plurality of shapes, e.g. of dovetail or other shape.

The term "recess" in the meaning of the invention should be understood as a hollow portion in relief that is used for fastening blades, e.g. portions in relief in the form of a hole that is optionally cylindrical, Christmas-tree shaped, hook-shaped, or of some other shape. The term "recess" should also be understood as covering any hollow portion in relief formed between male projections used for connecting blades.

By way of example, FIG. 52 shows a recess A formed between two male projections E that may be spaced apart from each other to a greater or lesser extent, each serving for fastening a respective blade (not shown). The blade includes a recess of shape complementary to the projection E. For a rotor having this configuration, shot peening may relate for example to a portion of the surface of the projection E. The support system may be connected by bearing against one of the two sides of a projection E.

Figure 53:
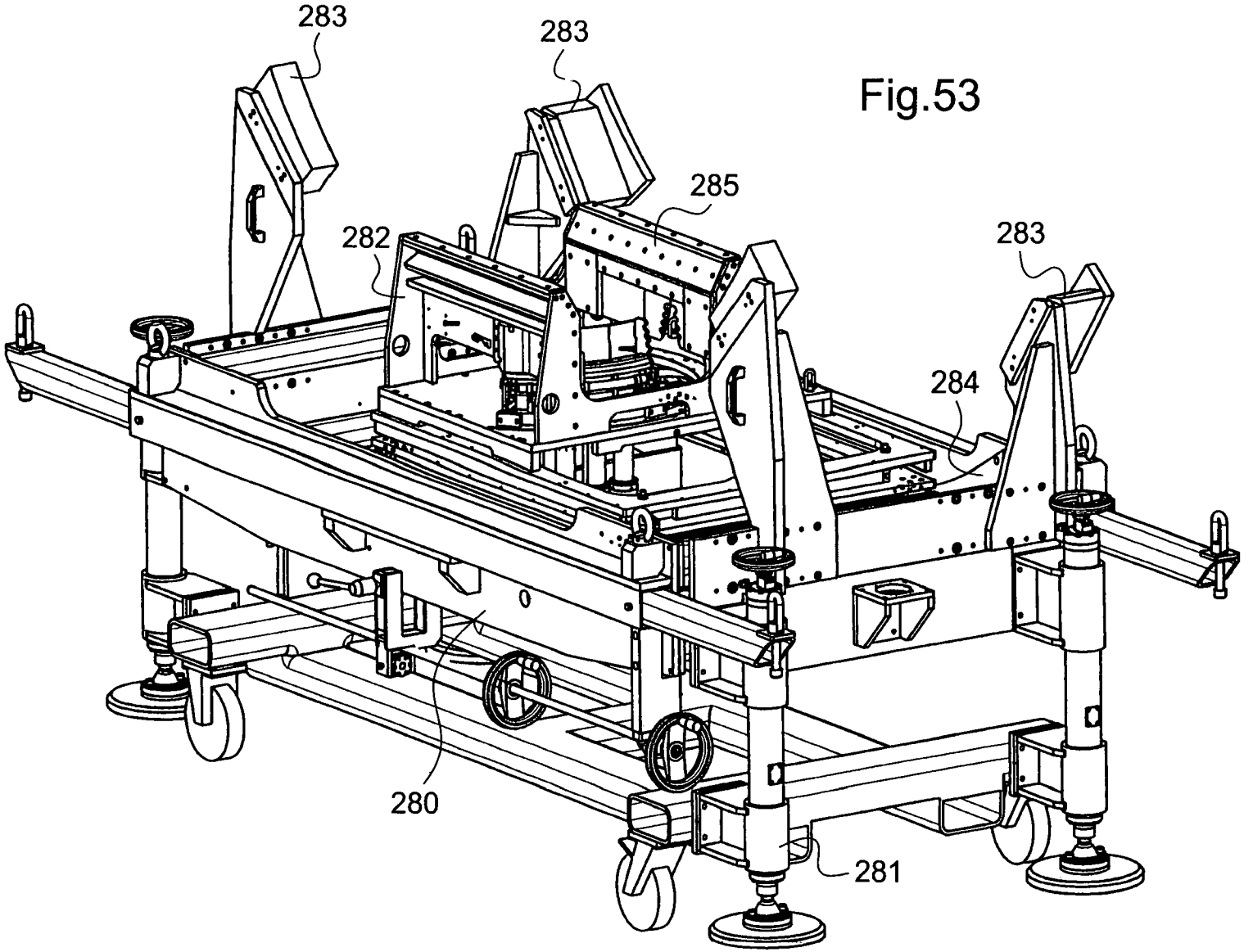
FIG. 53 is diagrammatic perspective view of a system for supporting an acoustic assembly in accordance with another aspect of the invention.

FIG. 53 shows another support system that is secured to at least one acoustic assembly in accordance with another aspect of the invention.

In this aspect of the invention, the support system is not fastened to the rotor, but comprises a frame 280 mounted on a leg assembly 281 and supporting a cradle 282, itself carrying at least one acoustic assembly 203 (not shown). In this aspect of the invention, at least a portion of the rotor (not shown), e.g. at least one recess, is treated with the help of the acoustic assembly secured to the cradle 282, which cradle is movable in rotation about the longitudinal axis of the rotor, concentrically relative to the periphery of the rotor.

The frame 280 is positioned on the leg assembly 281 in a manner that is adjustable in height and/or horizontally, and specifically parallel to the longitudinal axis of the rotor in the example shown.

The frame 280 carries positioning chocks 283 so as to place the cradle 282 concentrically relative to the rotor. The chocks can be provided with portions made of synthetic material having a low coefficient of friction. The chocks 283 may be removable.

The frame 280 also has curved guide rails 284 on which the cradle 282 can travel relative to the frame 280. By way of example, the guide rails 284 extend over an angular range of about 60°. The rails 284 may be fastened in non-removable manner, or in a variant in removable manner, e.g. so that they can be replaced, where necessary, by rails presenting some other shape or size.

The cradle 282 carries the acoustic assembly making it optionally possible to move the acoustic assembly relative to the cradle.

For example, for a fixed position of the cradle, it is possible to move the acoustic assembly relative thereto.

In a variant, the cradle can be moved relative to the frame while the acoustic assembly remains in a fixed position relative to the cradle. It is optionally possible to combine movement of the acoustic assembly relative to the cradle with movement of the cradle relative to the frame, in order to enable the acoustic assembly to be moved in more complex manner relative to the frame and to the rotor.

The cradle 282 may include two uprights 285 as shown.

One or both uprights 285 may close and/or extend one of the recesses, in particular one or more recesses laterally, at their opposite ends. For example, when the or each upright 285 extend(s) one or more recesses, it is possible to treat an entire recess, and possibly also to treat the inlet surface(s) outside it.

It is optionally possible to treat a plurality of recesses simultaneously if the cradle 282 carries a plurality of acoustic assemblies each having at least one sonotrode.

The shot peening treatment may be performed while the rotor is prevented from moving, by moving the cradle through a certain angle. When the rotor has been treated completely or in part over this angle, it may be turned through approximately the same angle, or through an angle that is slightly smaller, and then prevented from moving again so that treatment can be restarted, again moving the cradle along its rails. This operation can be repeated so as to cover the entire periphery of the rotor that is in need of treatment by shot peening.

The expression "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of shot peening at least a portion of a rotary machine including a rotor, in which shot peening is carried out with a rotor that is at least partly assembled, the rotor including peripheral recesses, the method comprising:

fixing a support system for supporting at least one acoustic assembly to the machine elsewhere than in any current recess to be treated; and shot peening at least one region of the machine using projectiles that are moved by the acoustic assembly.

2. A method according to claim 1, in which at least a first treatment of a first region of the machine and a second treatment of a second region of the machine which is spaced circumferentially from the first region are carried out with relative displacement of the machine and the acoustic assembly between the two treatments, operation of the acoustic assembly being interrupted between the two treatments.

3. A method according to claim 1, the support system being fixed on the rotor.

4. A method according to claim 1, the acoustic assembly being displaced relative to the machine during operation.

5. A method according to claim 1, the acoustic assembly being displaced along a current recess during its operation.

6. A method according to claim 1, the treatment being carried out with a plurality of sonotrodes disposed side by side.

7. A method according to claim 1, the treatment being carried out in situ, the rotor not being withdrawn completely from the machine.

8. A method according to claim 1, comprising:

fastening at least one connection arm of a support system in at least one recess other than a current recess for treatment, by engaging a connection part of said connection arm in the recess and locking the connection part using at least one of a counter-thrust system bearing against the rotor other than in the current recess and a clamping system acting on the connection part; and shot peening at least a portion of the current recess with an acoustic assembly secured to the support system.

9. A method according to claim 8, in which the connection arm is fastened in a recess adjacent to the current recess for treatment.

10. A method according to claim 9, comprising fastening connection arms in at least two recesses situated respectively on either side of the current recess for treatment.

11. A method according to claim 8, the acoustic assembly being moved relative to the support system in order to treat the current recess.

12. A method according to claim 8, the connection part of the connection arm engaged in the recess being locked using a counter-thrust system bearing against the rotor other than in the recess.

13. A method according to claim 8, the connection part of the connection arm engaged in the recess being locked using a clamping system acting on the connection part.

14. A method according to claim 8, the acoustic assembly being secured to guides that bear against the current recess.

15. A method according to claim 8, the acoustic assembly comprising a sonotrode having an end face that serves to set projectiles into motion, said end face extending along a curvilinear longitudinal axis.

16. A method according to claim 8, the acoustic assembly including a carrier part carrying at least two sonotrodes.

17. A method according to claim 8, the support system including at least two acoustic assemblies, the end faces of said at least two sonotrodes being directed at least in part one towards the other.

18. A method according to claim 8, the support system including at least two acoustic assemblies, the end faces of said at least two sonotrodes being elongate along respective longitudinal axes that form an angle relative to each other.

19. A method according to claim 1, the recesses serving to fix blades on the rotor.

20. A method of shot peening a rotary machine having rotor that is partially assembled, the method comprising treating at least a portion of the rotor using at least one acoustic assembly secured to a cradle that is movable in rotation concentrically about a longitudinal axis of the rotor.

* * * * *